US006021545A

United States Patent [19]

Delgado et al.

[11] Patent Number: 6,021,545

[45] Date of Patent: Feb. 8, 2000

[54] VACUUM CLEANER ATTACHMENT FOR THE WET CLEANING OF SURFACES

[75] Inventors: Antonio Delgado, Freising; Jürgen Thode, Wülfrath; Ludger Graute, Essen, all of Germany

[73] Assignee: Vorwerk & Co. Interholding GmbH, Wuppertal, Germany

[21] Appl. No.: 08/945,426

[22] PCT Filed: Apr. 18, 1996

[86] PCT No.: PCT/EP96/01614

§ 371 Date: Oct. 20, 1997

§ 102(e) Date: Oct. 20, 1997

[87] PCT Pub. No.: WO96/32876

PCT Pub. Date: Oct. 24, 1996

[30] Foreign Application Priority Data

| | | | |
|---|---|---|---|
| Apr. 21, 1995 | [DE] | Germany | 195 14 822 |
| Jul. 25, 1995 | [DE] | Germany | 195 27 176 |
| Mar. 22, 1996 | [DE] | Germany | 196 11 371 |

[51] Int. Cl.[7] ..... A47L 5/28; A47L 7/00

[52] U.S. Cl. ..... 15/322; 15/401; 15/367; 401/273

[58] Field of Search ..... 15/321, 322, 339, 15/401, 367; 401/198, 273, 283

[56] References Cited

U.S. PATENT DOCUMENTS

| | | | |
|---|---|---|---|
| 1,028,011 | 5/1912 | Ferenczy | 401/283 |
| 2,101,415 | 12/1937 | Stuart | 401/198 |
| 2,885,713 | 5/1959 | Morrill | 15/322 |
| 3,195,166 | 7/1965 | Wisner | 15/322 |
| 3,195,167 | 7/1965 | Wayne . | |
| 3,203,025 | 8/1965 | Schreur | 401/283 |
| 4,335,486 | 6/1982 | Kochte | 15/322 |
| 5,060,342 | 10/1991 | Brazier | 15/322 |

FOREIGN PATENT DOCUMENTS

| | | | |
|---|---|---|---|
| 0243323 | 10/1987 | European Pat. Off. . | |
| 0244172 | 11/1987 | European Pat. Off. . | |
| 542 193 | 5/1993 | European Pat. Off. | 15/322 |
| 0670140 | 9/1995 | European Pat. Off. . | |
| 2572920 | 5/1986 | France . | |
| 2665650 | 2/1992 | France . | |
| 2145620 | 4/1985 | United Kingdom . | |
| 2206478 | 1/1989 | United Kingdom | 15/322 |
| 6343 | 3/1994 | WIPO | 15/322 |

*Primary Examiner*—Gary K. Graham
*Attorney, Agent, or Firm*—Martin A. Farber

[57] ABSTRACT

Vacuum cleaner attachment (1) for the wet cleaning of surfaces (20), in particular of vertical surfaces, having a liquid applicator (21), a suction channel (28) having a mouth (15) and a cleaning element (19), the liquid applicator (21) being arranged, for the purpose of continuous working, for the continuous supply of liquid. A liquid supply tank (23) for supplying the liquid applicator (21) is disposed in the vacuum cleaner attachment (1), the liquid applicator (21) being supplied with the liquid by means of capillary action.

66 Claims, 17 Drawing Sheets

20
47
15
48
17
42
19
8
21
28
22
a
51
26
6
23
1
R
5
4
2

20
47
17
15
44
8
28
1
42
48
43
19
21
22
a
a
26
51
23
R
6

20
47
17
8
28
6
1
48
19
a
21
5
22
26
23
51
4
2

XVII
XVII
20
54
17
15
52
13
42
48
19
21
22
53
44
8
1
28
a
a
α
26
51
23
R
6

VACUUM CLEANER ATTACHMENT FOR THE WET CLEANING OF SURFACES

FIELD AND BACKGROUND OF THE INVENTION

The invention relates to a vacuum cleaner attachment for the wet cleaning of surfaces, in particular of vertical surfaces, having a liquid applicator, a suction channel having a mouth and a cleaning element.

In addition to the usual air vacuum cleaners, appliances are also known which can apply liquid, in particular cleaning liquid, and suck it back up in one operation. However, these are suitable only for the cleaning of hard floors. Such wet cleaning, which is performed in one operation, is not known for the cleaning of hard surfaces such as window panes, for example. In order to clean surfaces of this type, appliances are offered which have separate fresh water and dirty water tanks. Cleaning, including drying, takes place in this case in several steps. Firstly, by means of a pump and a spray nozzle, a cleaning solution is sprayed onto the hard surface, such as a window pane, in a first operation. This cleaning solution is distributed using a special sponge in a second step. This is followed, in a further final operation, by sucking up the dirty mixture using a suction nozzle, which is connected by means of a suction hose to a blower. What is disadvantageous in this arrangement is that continuous operation is not made possible. This is associated with disadvantages, in particular with regard to the improvement of walls.

SUMMARY OF THE INVENTION

An object of the present invention is to configure a vacuum cleaner attachment of the type in question for the wet cleaning of surfaces in an improved manner in such a way that, even if the appliance is used on vertical surfaces or, furthermore, even on surfaces whose surface normal vectors have a non-vanishing component in the direction opposite to the gravitation vector, such as sloping skylights or ceilings, the cleaning of the surface and the sucking up the cleaning liquid is performed in one operation.

On the basis of the arrangement in accordance with the invention, a vacuum cleaner attachment is provided which enables continuous working on surfaces, in particular vertical surfaces. This is achieved in that for the purposes of continuous working the liquid applicator is arranged for the continuous supply of liquid and the mouth of the suction channel is located downstream of the liquid applicator, relative to an application direction, the cleaning element being disposed in the region of the liquid applicator or between the liquid applicator and the suction channel. By this means, even vertical surfaces, in particular hard surfaces, such as window surfaces, can be cleaned in one operation in an advantageous manner. As a result of the fact that the liquid applicator is arranged for the continuous supply of liquid, the appliance according to the invention can be employed irrespective of any inclination of the surface to be cleaned and thus even in the case of vertical surfaces. Furthermore, working overhead is also made possible hereby. While working on the surface, liquid is continuously transferred to the surface by means of the liquid applicator, a cleaning of the surface being first effected by means of the cleaning element and a sucking up of the dirty mixture in the region of the suction channel being effected directly subsequently in the course of one movement of the appliance in one processing direction.

In this case, a configuration is preferred in which the liquid applicator is supplied with the liquid by means of capillary action. As a result of this configuration, active components for the application of the cleaning liquid can be dispensed with. Active components are known in the form of pumps and spray nozzles, these constructions having the disadvantage that, as the result of spraying the cleaning solution on, only a non-uniform moistening of the surface to be cleaned is effected. Furthermore, in this case, other regions, including, for example, the window frames in the case of cleaning windows, are concomitantly and inadvertently also sprayed. Furthermore, in the case of the known prior art, it has transpired that the cleaning solution runs down in droplets or else as a stream in the case of vertical and sloping surfaces, such as for example window surfaces. In the case of the invention specified, this is improved in an optimum way by the capillary transport. Here, a uniform application of cleaning agent to the surface is effected without a pump or other electro-mechanical or electronic means. The cleaning medium, preferably water, alcohols or surface-active substances, is applied to the surface to be cleaned, by means of the liquid applicator, in such quantities as, on the one hand, ensure a good cleaning effect but, on the other hand, prevent flow caused by gravity. According to the invention, the amount needed in this case is around 2 to 10 g water per square metre of hard surface. The invention thus allows large hard surfaces to be cleaned reliably with very small amounts of cleaning medium.

In a further embodiment of the subject-matter of the invention, provision is made that, with respect to the application area, the liquid applicator is subdivided into substructures. This subdivision is preferably carried out in such a way that a continuous liquid applicator, preferably extending over virtually the entire width of the vacuum cleaner attachment, is approximated. The substructures may be formed, for example, in a honeycomb or triangular shape or else rectangular or circular shape. In this case, an arrangement is preferred in which the liquid applicator comprises a tuft of bristles accommodating a specific supply of liquid. The said tuft of bristles may be formed continuously in the form of a strip of tufts of bristles, that is to say over virtually the entire width of the vacuum cleaner attachment. However, as already mentioned, substructures in the form of honeycomb or triangular arrangements of tufts of bristles are also conceivable. The application of cleaning agent to the surface to be cleaned is effected by the capillary interstices of the tufts of bristles. In this case, however, cleaning agent is delivered only when the tufts of bristles have contact with a surface, for example with a window surface. If the bristles project beyond an underside of the vacuum cleaner attachment, then provision can be made for the bristles in this region to be clamped around by a separate bristle holder, which prevents the bristles from fraying. It has been proven to be particularly advantageous for a tuft of bristles to consist of bristles which include an angle of about 30–60° with the surface to be cleaned. What is achieved by this is that, as a result of the arrangement of the bristles selected obliquely in relation to the surface to be cleaned, the said bristles adapt to the surface to be cleaned over virtually the entire bristle surface by means of slight lateral bending and thus compensate, for example, for production tolerances and irregularities on the surface to be cleaned.

The supply to the liquid applicator, in particular to the tufts of bristles, is performed in a preferred arrangement by the liquid applicator being disposed in a capillary store, delivery from the capillary store being effected by capillary action. As already mentioned, the invention permits reliable cleaning of large surfaces using very small amounts of cleaning medium. This therefore makes it possible to store the required quantity of cleaning medium in a relatively small tank, such as a capillary store. In this case, an embodiment is preferred in which the capillary store can hold ready 30 to 150 ml of cleaning liquid. In order to ensure the ability of the capillary transport to function in any position of use, the capillary store is equipped with a transfer medium which at any time has contact, at least locally, with the cleaning medium, that is to say the tufts of bristles of the liquid applicator. According to the invention, the transfer medium is to be arranged in terms of its wetting properties and geometry in such a way that the capillary transport from the capillary store to the surface to be cleaned takes place in the desired amount. The necessary adaptation is effected, according to the invention, by the selection of suitable materials, their surface treatment and the geometric configuration. In this case, an arrangement is preferred in which the capillary store consists of wadding, which ensures a continuous supply of cleaning liquid to the tufts of bristle, caused by the capillary action, in any position of the vacuum cleaner attachment. According to the invention, provision may furthermore be made for the mouth of the suction channel to be slit-like in form. It is preferred to connect the vacuum cleaner attachment to a commercially available vacuum cleaner.

In order to clean hard surfaces, in particular vertical surfaces, the vacuum cleaner is switched on, after which cleaning of the hard surface can be effected. During the cleaning operation, cleaning liquid is applied to the surface to be cleaned by means of the applicator and conducted away again via the suction channel in the same operation. In this case, in a preferred form, the mouth of the suction channel has a width which corresponds to the width of the liquid applicator, in particular to a strip of tufts of bristles. In order to ensure reliable transport of the dirt/cleaning suspension, and to provide residue-free drying of the surface to be cleaned, according to the invention air velocities from 30 to 90 m per second are developed in the suction region. To this end, it is advantageous to configure a flow channel in such a way that the abovementioned local flow velocities are established with only low air volume flows of 3 to 15 l per second, preferably 1.5 to 7 l per second. According to the invention, the negative pressure produced at the mouth of the suction channel can be used for the purpose of supporting the capillary transport of the cleaning medium out of the capillary store. As already mentioned, the suction channel or the mouth of the suction channel is arranged downstream, in the working direction, relative to the liquid applicator. In order to make it possible to clean surfaces in two directions at right angles to the vacuum cleaner attachment longitudinal edge, the attachment may be formed to be symmetrical with respect to the liquid applicator, in particular the strip of tufts of bristles, that is to say provided with a second suction channel mouth. In order to ensure optimum cleaning of surfaces, provision is furthermore made for the cleaning element to define an edge of the mouth of the suction channel.

To this end, the cleaning element is defined in the region between the liquid applicator and the suction channel. In order to support the capillary transport of the cleaning medium out of the capillary store, caused by the negative pressure produced at the mouth of the suction channel, it is further proposed that the cleaning element be provided with movable or local openings. It is preferred for the cleaning element to comprise a sealing element with a cleaning nonwoven fabric fitted to it. The latter has a large mechanical interaction with the surface to be cleaned. Alternatively, the cleaning element may also comprise a sealing element with fitted bristles, felt or the like. However, in this case it is essential that a water-repellent material is used. The cleaning nonwoven fabric or the like is preferably configured in such a way that high shear forces are exerted on the dirt to be detached. In addition, the sealing element of the cleaning element seals the suction channel relative to the liquid applicator or to the tufts of bristles, respectively. The delivery of air is effected only in the region of the cleaning nonwoven fabric or the like, only a small air gap being provided during operation between sealing element and surface to be cleaned in the region of the cleaning nonwoven fabric or the like. This leads to an increase in the air velocity in this region. In order to form a suction space, it is proposed that a further edging, of the mouth of the suction channel, located downstream in the processing direction, consists of a lip that is impermeable to air. The latter may be formed as a rubber lip which, during a working operation on surfaces, draws off the cleaning agent/dirt mixture from the surface. As a result of the high air velocity in the suction channel, the mixture is transported away through the mouth of the suction channel, this counteracting any dripping of dirty water from the vacuum cleaner attachment after the vacuum cleaner has been switched off.

Furthermore, provision may be made for the mouth of the suction channel to consist of a multiplicity of individual suction channel sections. As already mentioned, one type of arrangement consists of a drawing-off rubber, resting continuously on the surface to be cleaned, in the form of the air-impermeable lip, which at the same time forms a limit for the suction space on that side facing towards the cleaning element. According to the invention, it is proposed that from a main suction channel located in the interior of the nozzle, over the entire nozzle width, smaller spur channels in the form of suction channel sections lead from the main channel directly to the draw-off rubber or to the air-impermeable lip. The spur channels effect immediate drying of the lip, by which means water streaks are prevented in the event of renewed placing of the lip, for example on window panes. Furthermore, a suction of this type improves the pick-up of water by the suction at low air volume flows as a result of very high air velocities in the suction channel sections, because of the small cross-sections. In this case, it proves to be particularly advantageous for a suction channel section to be partially bounded by the lip. For instance, the spur channels mentioned may be formed in such a way that they are provided in the form of comb-like grooves in the region of the bottom of the nozzle housing, open at the edge. In order to form spur channels, the spur channels are bounded on one side by the lip. Furthermore, according to the invention, it is proposed that the suction channel sections be arranged running obliquely such that they run at an angle towards the suction channel. This is advantageous from the point of view of flow mechanics, in particular if, as preferred, the axes of the suction channel sections intersect at a point which in turn lies on a central axis of the suction channel. In this case, this point of intersection may lie in the region of the mouth of the suction channel.

However, a construction is preferred in which the point of intersection is provided outside the mouth of the suction channel, in the region of the suction channel. What proves to be critical here is, in particular, the operation of setting down a rubber lip, in particular the abovementioned air-impermeable lip, for example at the edges in window frames, since here the rubber lip is partially severely bent. The consequence of this is that the cleaning liquid is in certain circumstances not completely drawn off from the pane. As a result, streaks can form at these points. According to the invention, this problem is solved in that the lip is formed as a double lip.

Accordingly, the first lip is followed by a second lip—as seen in the working direction. In this case, the arrangement is such that the outer lip consists of a material which is softer than the inner. Also preferred here is a rubber lip which is very flexible and which, because of its downstream disposition, still rests on the pane even during a drawing-off operation, for example in the region of a window frame. In this case, the outer lip is to be fitted to the first lip in such a way that the latter does not rest on the surface to be cleaned, in particular the pane, during a normal drawing-off operation, and draws off the pane only in the event of a bending down of the attachment appliance, for example at a window frame. This is achieved in that the outer lip is formed to have a greater spacing from the surface to be cleaned in such a way that, during a normal cleaning operation, the said lip does not come into contact with the surface to be cleaned. In order to reduce or even eliminate any remaining residual amounts of water, it is proposed to configure the air-impermeable lip in the contact region with the surface to be cleaned in such a way that residual water is transported in an optimum way towards the suction channel and is entrained from there by the air volume flow.

To this end, it is proposed that the lip has, on its side facing the liquid applicator, channels running in the width direction of the lip, which channels widen in their cross-section towards the suction channel. These channels are preferably arranged in the contact region of the lip with the surface to be cleaned. These channels are, for example, wedge-shaped in plan view, the depth—starting from the tip of the wedge—being enlarged towards the broad side of the wedge. As a result of this form, locally different capillary pressures are achieved, with the result that any residual water is transported as far as the suction channel as a result of the pressure gradient. In an advantageous development of the subject-matter of the invention, provision is made for a residual water wiper to be provided further downstream of the lip. The said wiper picks up any residual water remaining on the surface when the cleaning is completed. This is effected automatically by the lifting-off operation of the vacuum cleaner attachment effected at the end of the wiping operation. The residual water wiper preferably consists of a commercially available, highly water-absorbent porous material, in which residual water is sucked up by capillary action. In the case of particularly stubborn contaminations or in other cases in which an increased amount of cleaning agent has to be applied to the surface to be cleaned, it is conceivable to employ the negative pressure present in the suction channel in order to increase the cleaning agent volume flow in the liquid applicator. For instance, provision may be made for an appliance part located between the mouth of the suction channel and the liquid applicator to be arranged to be displaceable in such a way that a suction channel cross-section acting on the liquid applicator can be formed or enlarged.

In the case of a normal mode of operation, as described previously, the suction channel and the liquid applicator are separated physically from one another, the cleaning liquid being brought to the surface to be cleaned by means of capillary transport. The physical separation may be a displaceable appliance part which, in order to increase the cleaning agent volume flow in the liquid applicator, can be moved in such a way that the suction channel cross-section is enlarged in the direction of the liquid applicator. In a preferred arrangement of the subject-matter of the invention, provision is made to this end that the cleaning element disposed between the mouth of the suction channel and the liquid applicator is formed as a displaceable appliance part. This cleaning element provides the physical separation in the usual way. If required, this cleaning element may preferably be displaced by the user, for example by actuating a button or a slide. As a result of the displacement, physical separation between the suction channel and, respectively, the suction channel opening and the liquid applicator is removed, so that a negative pressure with respect to the environment prevails at the latter, as a result of which more cleaning liquid is conveyed through the capillary applicator. It is proposed that the liquid applicator, the cleaning element and the mouth of the suction channel be arranged in a pivotable working holder. This construction permits the vacuum cleaner attachment to be handled very easily. Optimal adaptation of the suction surface to the physical arrangement of the surface to be cleaned is thus ensured. Furthermore, it is provided that the end faces of the liquid applicator and of the cleaning element and the end edge of the lip lie on one plane. In order also to connect the vacuum cleaner attachment according to the invention to commercial vacuum cleaners, according to the invention it is proposed that the suction channel run through a filter in order to filter sucked-up liquid out of the sucked-up air.

In this filter, a separation of dirt, cleaning medium and air takes place. Accordingly, the dirt/cleaning medium suspension is separated in the filter. An air stream, which is free of condensed material and at the same time may carry small quantities of solid particles with it, flows out from the vacuum cleaner attachment. This filter may be disposed in a vacuum cleaner connection housing, by which the connection to a suction hose or the like of a vacuum cleaner is effected. According to the invention, it is proposed that the filter cooperate with a storage medium for filtering out, in order to form a liquid store. The air stream flowing from the vacuum cleaner attachment to the vacuum cleaner can furthermore be used for the purpose of drying the dirt/cleaning medium suspension, so that the storage medium only stores small amounts of liquid and can therefore be configured to be small in its dimensions. According to the invention, the liquid store may be formed at least from a porous medium, with the result that the condensed phase is reliably retained, but as a result of the large surface of such media, as much cleaning liquid as possible is transferred into the gaseous form as a result of interaction with the air stream and is entrained. The porous medium, which has capillary properties, may consist, for example, of wadding, sponge, clay granules, paper, active carbon or the like. Preference is given to an arrangement in which the storage medium has a fibrous material which, as a result of capillary action, optionally a tubular configuration of the fibers, sucks up the moisture and releases it through micro-slits only by evaporation.

To this end, the storage medium may consist of textile fibers, which store the liquid in microcavities, transport it as a result of capillary action and convey it to the surface through microchannels or micro-openings, where it then quickly evaporates. Since in this case, the relative moisture of the air volume flow delivered lies below the dew point, any danger to the user, for example as a result of electric short-circuits, is ruled out. The fibrous material is in this case used in principle as an intermediate store for the liquid. The incoming air volume flow, mixed with liquid, gives up the entrained moisture to the textile fibers and leaves the store only with a relative humidity which is sufficiently low that any danger as a result of short-circuits is avoided. Furthermore, it is provided that the filter is bounded in the suction direction by a liquid-impermeable membrane. To this end, the filter is to be configured in such a way that liquid droplets on the membrane are transported away from this membrane into the storage medium by the capillary action of the storage medium. As a result of the porous configuration of the storage medium, the sucked-up air passes through the storage medium on labyrinthine paths in such a way that, optionally by means of filtering out, liquid separation is effected by deflecting the flow. As has already been mentioned, it is preferred that the storage medium is an open-pore foam and/or active carbon. However, a configuration is also conceivable in which the liquid store is bounded only by a membrane and does not have any porous storage medium. In order to rule out completely any danger to the user, the cleaning liquid in condensed form must not pass to live parts of the vacuum cleaner needed for the suction. This can be achieved in that the suction is controllable, actuatable by a specific degree of filling of the liquid store.

If the filling level of the liquid store exceeds a specific level, there is then the risk of some liquid passing out of the store into the waste air stream leading to the vacuum cleaner. Provision may be made here, for example, for a liquid sensor to be disposed at a suitable point on the attachment, for example directly upstream of the interface to the vacuum cleaner, which sensor interrupts the voltage supply immediately upon contact with condensed cleaning liquids. Moisture sensors of this type are commercially available. A configuration is preferred in which a pressure drop established as a result of the degree of filling of the liquid store is used for the closing movement of a valve closing the suction channel. A valve of this type may, for example, be located downstream in the suction direction of the already mentioned liquid-impermeable membrane. This type of configuration has the advantage that the membrane has to withstand a lower liquid retaining pressure than without a safety valve, since above an adjustable pressure difference, the safety valve closes and relieves the membrane. As a result of this configuration, the use of the attachment on virtually all commercially available vacuum cleaners is made possible. In a further arrangement, it is provided that a front side of the valve is used to support the membrane at a high degree of filling of the liquid store. As a result of this configuration, the membrane is mechanically supported at high liquid pressures. It is further proposed that the closing valve have a diaphragm base which is loaded on one side with the pressure prevailing upstream of the liquid-impermeable membrane and on the other side with the pressure of the suction channel.

In an exemplary configuration, provision can be made to this end for the differential pressure present at the water-repellent but air-permeable membrane to be transferred to the elastic diaphragm base by means of a pressure balancing channel and a pressure balancing opening. The said diaphragm base in turn actuates a plunger which has a sealing cone, for example made of rubber, provided on it. The sealing cone is held in an open position during normal operation by means of a tension spring. As soon as the pressure difference at the water-repellent membrane increases, for example as a result of a water film on the membrane, the sealing cone closes a passage opening in the region of the suction channel, whereby the membrane is relieved. After this, the suction air stream is suppressed, which also indicates to the user that the liquid store has reached a maximum filling level. Before working further, it is first necessary to empty or exchange the liquid store. In order also to offer the user visual monitoring of the filling level in the liquid store, provision can be made for a displacing movement of the valve to be transferred to an indicator in order to display the degree of filling of the liquid store. As a result of this type of simple mechanical indicator, for example coupled with the sealing cone, it is possible to indicate to the user that the storage element is now loaded and that this is to be exchanged or to be regenerated. In a further arrangement of the subject-matter of the invention, instead of or as a supplement to the liquid-impermeable membrane, use may be made of an element which binds condensed water. To this end, it is proposed that the liquid store consist at least partially of a material, such as polyacrylate, which varies in the sense of an increase in volume when liquid is taken up. According to the invention, this binding may take place chemically or chemo-physically.

In the preferred embodiment mentioned, the water-binding medium is embedded in a porous cavity. Known water-binding media are, for example, high molecular weight, industrial substances, such as polyacrylate or the like, but also natural products such as potato starch. The water-binding media change their state on contact with condensed water in the form that these media swell up, so that a large pressure drop is produced at these and the air volume flow finally comes to a standstill with increasing amounts of water. By this means, transport of condensed material into the vacuum cleaner is ruled out. In a further arrangement, provision is made for a special flow path to be provided in the swelling material. This can be implemented, for example, by the separate flow path being formed with alternating directions with a view to enlarging the surface. As a result of this, a relatively large surface is provided to take up condensed material. It is further proposed that the wall of the separate flow path consist partially or completely of the swelling material. For instance, the construction may be selected such that an appropriately shaped, water-impermeable carrier, for example closed pore foam, forms the flow path, the wall of this separate flow path being coated with the swelling material. If condensed liquid occurs in the region of the separate flow path, the increase in volume of the water-binding medium reduces the gap width down as far as complete interruption of the volume flow, as a result of which danger to the user is ruled out. In a preferred arrangement of the subject-matter of the invention, provision is further made for a liquid-impermeable membrane to be located upstream of the swelling material.

The swelling material or the separate flow path equipped with this swelling material thus forms a safety device, which is located downstream of the liquid-impermeable membrane. If, for example as a result of excessively high liquid pressures in the region of the membrane, condensed media should pass through, these are then picked up in the region of the safety section formed by the swelling material. With increasing amounts of condensed material, the water-binding medium closes the suction channel formed by the separate flow path, as a result of the swelling up. In an advantageous development of the subject-matter of the invention, provision is made for the liquid stored in the storage medium to be able to be fed back to the liquid applicator. By this means, a closed circuit is formed which permits the liquid picked up in the storage medium to be fed once more to the capillary store in the working holder, for further capillary transport to the surface to be cleaned. For instance, this feeding back may be achieved by the liquid being sucked back out of the liquid store into the capillary store. The suction capacity of the connected vacuum cleaner is accordingly used to feed back the stored liquid to the liquid applicator. To this end, it is proposed that a switchable flow connection be provided between that side of the membrane on the blower side and the capillary store. This switchable flow connection may, for example, be a flexible pipe or the like, which connection can be closed or opened, or example by a suitable shut-off element. Via this flow connection, in an open position the liquid collected in the liquid store can be sucked back into the capillary store.

The shut-off element switching the flow connection can be actuated, for example, by the user, who releases the connection by actuating an appropriate operating element. Furthermore, in order to carry out the sucking back of liquid into the capillary store, a further, preferably flexible, hose is provided, which is disposed between the liquid store and the capillary store. This connection can also be switched in parallel to the flow connection, this in order to prevent uncontrolled running back of cleaning liquid out of the capillary store into the liquid store. A construction is preferred in which the flow connection is open in a state in which the suction cleaner attachment is not resting on the surface to be cleaned. The result of this is that, in a position in which the vacuum cleaner attachment is not in contact with the surface to be cleaned, the capillary store has applied to it a larger negative pressure than that which prevails in the liquid store, but this occurs only if the appropriate connections are opened, for example by the user. To this end, as already mentioned, it is proposed that the releasing be effected by actuating a release switch. In order to achieve feeding back of the liquid out of the liquid store into the capillary store by means of suction force, only the appropriate connections of the flow path and of the liquid path are opened. The greater negative pressure now present on the capillary store effects a sucking up of the liquid out of the liquid store, through the open connection, to the capillary store. The open flow connection, which is here arranged at one end, via which air is sucked in, preferably has an air-impermeable membrane. In order to offer simplified handling of the vacuum cleaner attachment, it is further proposed for a push button switch to be provided on the vacuum cleaner attachment, this switch releasing the flow connection when lifted off from the surface to be cleaned.

This configuration results in more reliable handling of the attachment, since when the appliance is placed on a surface to be cleaned, suitable shut-off elements in the region of the flow connection and, optionally, in the region of a liquid connection, are closed. Putting the appliance in place once more effects an opening of the connections in the meantime, whereby, even in these short periods, at least proportions of the stored liquid can be conveyed back. By this means, a closed circuit is formed, as a result of which the cleaning of relatively large areas is made possible for a relatively small capillary store. In this case, provision can be made for the feeding back to be effected via capillary transport. The latter can be formed by a capillary conductor arranged between the capillary store and the liquid store. In order, in particular in the case of a construction in which the liquid is sucked back out of the liquid store into the capillary store, to save a shut-off element in the region of the connection between the liquid store and the capillary store, provision can be made for the capillary store to be connected to the liquid store via capillary conveying lines. Only in the event of a greater negative pressure prevailing in the region of the capillary store than in the liquid store is the liquid transported into the capillary store via the conveying lines. Furthermore, provision can be made for the feeding back to be effected only via capillary channels which are suitably configured in such a way that they establish the pressure difference necessary for the conveying. Here, it is preferred that such conveying takes place only in the periods in which the user has switched off the appliance.

In order, during the feeding back of stored liquid to the liquid applicator, to ensure an adequately high filtering of the used liquid, provision is made for the suction air introduction and the liquid feedback in the liquid store to be physically removed from one another to such an extent that the liquid fed back is at least adequately cleaned of dirt particles carried in the suction air. This means in detail that the cleaning liquid that is sucked into the liquid store and is mixed with dirt particles must firstly pass through a sufficiently long path through the storage medium, before it can be fed back once more to the liquid applicator via the liquid return. According to the invention, the negative pressure produced at the mouth of the suction opening can be used in order to feed back the cleaning fluid to the capillary store of the liquid applicator after the filtering of the dirt, so that a closed circuit is produced and therefore, using small amounts of cleaning liquid, large hard surfaces can be cleaned. In this case, according to the invention, the vacuum cleaner attachment is to be configured in such a way that the negative pressure at the mouth of the suction channel is greater in magnitude for any position of use of the vacuum cleaner attachment than the negative pressure upstream of the storage medium, plus the pressure drop in the filter and in the capillary medium. Furthermore, it is proposed that, in order to provide the pivotable arrangement of the working holder, the suction channel in the region between the working holder and the appliance connection housing having the filter is formed by means of a thin, flexible hose or the like. In order to indicate the take-up capacity of the storage medium, it is provided that the liquid store be equipped with a liquid level indicator.

To this end, a transparent pane may be provided on an upper side of the connection housing. To this end, the filling level indicator is formed as a capillary sensor. Depending on the liquid charging of the storage medium, the said sensor can change colour or other optical properties, such as the light reflection. If, by means of the capillary optical filling level indicator, complete filling of the liquid store is indicated, then the user is provided with a signal which is intended to induce the latter to interrupt the cleaning operation and to empty the store. As an alternative to this, provision can be made for the liquid store to be equipped with a negative pressure sensor in order to register the loading state. When a maximum loading of the liquid store is reached, a water film forms on the membrane provided at the filter end in the suction flow direction, which film effects an increase in the negative pressure on the suction side of the membrane. This negative pressure is registered by means of the negative pressure sensor, which automatically interrupts the sucking up of air and liquid, so that it is also not possible for any liquid to drip from the vacuum cleaner attachment after the vacuum cleaner has been switched off. In order in general to achieve a further increase in the cleaning effect, provision may be made according to the invention for solid additives (spherical, fiber-like particles and the like) to be added to the cleaning medium. In the case of the previously known solutions, one disadvantage is that these appliances, following the cleaning of surfaces—when the appliance is removed from the surface—always leave a residue of dirt and moisture on the surface. In order to counteract this, it is proposed according to the invention that the edge of the mouth of the suction channel be capable of being moved out on one side, to be specific on the side facing the liquid applicator, in such a way that, optionally whilst tilting the working holder, the liquid applicator and, optionally, the cleaning unit is lifted off when the mouth of the suction channel is further rested on the surface to be cleaned.

If the vacuum cleaner attachment is tilted away from the surface to be cleaned before completing the cleaning operation, but not yet removed from the surface, then firstly the liquid supply is interrupted by lifting the liquid applicator. In this case, the cleaning unit is also advantageously lifted, as is the sealing lip. Only the mouth of the suction channel still rests on the surface, that side of the edge of the mouth of the suction channel facing the liquid applicator moving out appropriately. The sucking up of residual liquids and dirt can now take place, without new cleaning liquid being able to flow subsequently. In this case, provision is made for the movable edge of the mouth of the suction channel to be movable substantially in the suction direction. In order to achieve atomization of residual moisture, it is proposed that, when the edge of the mouth of the suction channel is moved out, a front edge is displaced in such a way that a comb construction comes into effect, in order to form closely bounded suction channels. As a result of this configuration, the air is sucked through the bounded suction channels at high velocity, as a result of which residual liquid which is still on the pane is atomized. This can additionally be improved by sharp flow edges and deflections directly downstream of the comb. This atomization of the liquid is further optimized to the effect that the movable edge of the mouth of the suction channel, forming a rear edge, is of comb-like construction. When the working holder is tilted away from the surface to be cleaned, only the two combs of the edges of the mouth of the suction channel still have contact with the surface.

The material of the comb-like sealing elements is preferably a water-repellent, commercially available plastics. In a further arrangement, provision can be made for the front edge to be pivotably mounted in the working holder. According to the invention, it is proposed that the rear edge be constructed like a plough in order to form closely bounded suction channels. As a result of this configuration, a comb is likewise provided on a rear edge, but this comb comes into effect only when the working holder is tilted away from the surface, the front edge of the mouth of the suction channel encountering with its comb the surface to be vacuumed, as a result of the pivoting movability. Thus, in the simplest way, the sucking up of residual liquid and dirt is provided when completing the cleaning operation. In a development of the subject-matter of the invention, provision is made for the liquid applicator to be able to be displaced in relation to the lip in such a way that the liquid applicator can be moved towards or away from the surface to be cleaned. This configuration also enables good handleability of the vacuum cleaner attachment, with optimum adaptation of the suction surface to the physical arrangement of the surface to be cleaned. As a result of the displaceability of the liquid applicator in relation to the lip, both the liquid applicator and the lip always remain in contact with the surface to be cleaned in the course of the cleaning. In the event that the vacuum cleaner attachment is placed on at a relatively acute angle to the surface to be cleaned, the engagement of the liquid applicator by the surface to be cleaned has the effect that the liquid applicator is pushed back. As a result of the displaceability of the liquid applicator, the contact between the liquid applicator and lip and the surface to be cleaned is also not released in the course of the cleaning movement, even if the user, in the course of this cleaning movement, tilts the vacuum cleaner attachment in such a way that a new angle is established between the attachment and the surface to be cleaned.

The vacuum cleaner attachment according to the invention can accordingly be employed irrespective of the angle of attack on the surface to be cleaned, and thus offers improved handling. To this end, it is further proposed that the liquid applicator, together with the capillary store, be displaceable. The liquid applicator and the capillary store are considered as a unitary component and are displaced together in order to change the position in relation to the lip. By this means, complicated sealing mouldings are dispensed with, which would otherwise be needed if only the liquid applicator were displaceable. Furthermore, it proves to be advantageous for the suction channel to be formed to be static, and for the liquid applicator, together with the capillary store, to be displaceably disposed on the suction channel. In this case, preference is given to a configuration in which the suction channel with its suction channel mouth and the lip are formed as a connected-together component. The result of this is that the lip and the mouth of the suction channel are also fixed with respect to the liquid applicator. The suction channel leading away from the mouth of the suction channel is preferably used as a guide element for the displaceable liquid applicator. In this case, it proves to be advantageous for the liquid applicator to be able to be pushed back counter to a spring. The latter always effects automatic resetting of the liquid applicator into a basic position. The optional displacement is possible only counter to the spring force.

However, this spring force is arranged in such a way that the displacement of the liquid applicator and of the capillary store coupled to the latter may be effected without great effort, for example in the course of a cleaning movement, by means of a tilting movement of the vacuum cleaner attachment brought about by the user. In a preferred arrangement, provision is made for the spring to be arranged concentrically with the suction channel. Provision is furthermore made for the liquid applicator, optionally including the capillary store, to be held on the suction channel via a sleeve-like connecting element. In a preferred configuration, this sleeve-like connecting element encloses the suction channel and carries the liquid applicator together with the capillary store. A spring surrounding the suction channel acts on the sleeve-like connecting element in such a way that the liquid applicator, optionally including the capillary store, is loaded into a front position, contacting the surface to be cleaned. In a preferred arrangement, provision is made for the vacuum cleaner attachment to be able to be tilted over an angular range of about 40°, without the lip and the liquid applicator losing contact with the surface to be cleaned. It also proves to be particularly advantageous for a frontmost and/or a rearmost position of the liquid applicator to be latchable. In the frontmost position, which corresponds to a basic position, the liquid applicator projects evenly beyond the lip. This position can be secured by a latching element, for example acting between the sleeve-like connecting element and the suction channel. In this position, only the liquid applicator acts on the surface to be cleaned, this, for example, for the purpose of a first precleaning of the surface, detaching coarse dirt.

During such pre-cleaning, drawing off the surface to be cleaned by means of the lip is not desired. This configuration results in the possibility of separate wetting or, respectively, of washing without suction. After the latching connection has been released, the liquid applicator, optionally including the capillary store, can be displaced back counter to the force of the spring arranged concentrically with the suction channel, this taking place at most as far as a rearmost position in which the lip is arranged evenly in front of the liquid applicator or, respectively, in which the liquid applicator is set back evenly in relation to the lip. This position is also secured by a latch. In this rearmost position, only the lip acts on the surface to be cleaned, this for example for the purpose of drawing off and sucking up residual water in regions which are difficult to access, in which regions the liquid applicator would interfere. This further yields the advantage of separate drying, for example of a glass pane following rain. Following releasing of the latching connection, the liquid applicator, if appropriate including the capillary store, moves back once more into the basic position, which can then optionally be secured by a latch. If this securing by a latch is not used, then the liquid applicator is freely displaceable counter to the spring force between the basic position and the hard edge functional position, for the purpose of continuous contact between the liquid applicator and lip and the surface to be cleaned in the course of the cleaning movement. In a development of the subject-matter of the invention, provision is made for the cleaning element to consist of a cleaning cloth which is wetted on the rear side. In this case, it proves to be advantageous for the cleaning cloth to be tensioned over a capillary device and wetted by this.

In this case, a micro-nonwoven cloth is preferably used. In a preferred arrangement, this capillary device is the liquid applicator, the cleaning cloth being tensioned over the entire length of the capillary device, measured transversely to the movement direction of the vacuum cleaner attachment, to be specific in such a way that the cleaning cloth is fastened at one end in the region between the capillary device or the liquid applicator and the mouth of the suction channel, and at the other end on that side of the capillary device facing away from the mouth of the suction channel. In this case, the cleaning cloth is preferably tensioned relatively tautly over the capillary device and extends essentially parallel to the surface to be cleaned, at least in the region applied to this surface. By contrast with the configurations previously described, in the case of this configuration the surface to be cleaned is not firstly wetted with a cleaning liquid and subsequently cleaned by the cleaning element which follows in the working direction. In this case, it is rather that the cleaning element or the cleaning cloth is wetted directly on the rear side by the capillary device or liquid applicator, and the detachment of dirt on the surface to be cleaned is performed by a directly wetted cleaning element. By means of this always wetted cleaning cloth, more severe contaminations and grease contaminations can also be detached. Furthermore, by means of this configuration, the bristles of the capillary/moisture device can also be protected. In order to be able to remove even stubborn contaminations, the vacuum cleaner attachment according to the invention may also be provided with a scraper edge. As has already been mentioned, it may be possible to trigger the suction as a function of a specific filling level of the liquid store.

If this filling level exceeds a specific level, then there is the risk that any liquid will pass out of the store into the waste air stream leading to the vacuum cleaner. It has already been proposed to use a valve for this purpose, which interrupts the suction if a filling level is exceeded. In an alternative arrangement of the subject-matter of the invention, it is proposed that the valve be held in the open position by a blocking element, which blocking element is actuatable by being loaded with moisture. When a predetermined filling level in the liquid store is reached or exceeded, the blocking element, which is preferably located downstream in the flow direction, is acted on by moisture. As a result of this, the valve is displaced into a blocking position in order to interrupt the suction air stream. As soon as the blocking element is freed of this moisture, it displaces the valve back once more into the open position. It is thus possible, for example, to provide a blocking element which expands under the action of moisture and thus displaces the blocking element into a blocking position and, after the moisture has been withdrawn, reverts once more into the original position in order to displace the valve into the open position. However, a configuration is preferred in which the blocking element consists of a material which takes up moisture and which is compressible in dependence on taking up a specific amount of liquid. To this end, it is proposed that the valve be supported via a control element, spring-loaded against the blocking element. If the liquid taken up exceeds a predetermined level, then the blocking element is acted on by moisture, which leads to a compressibility of the blocking element. The blocking element yields to the spring pressure of the valve, whereby the latter is displaced into the blocking position. In relation to this configuration, it is finally proposed that the blocking element consist of a sponge-like material.

For instance, a natural sponge can be provided here, which is disposed directly downstream of the liquid store. The latter is gradually filled by sucked-up liquid. If the liquid level reaches the transition to the blocking element, then the latter sucks up some of the liquid. This loading with moisture has the effect of softening the sponge-like material, the latter being compressible in order to displace the valve into the blocking position. The previously described blocking device can be used in the case of virtually any types of liquids, such as water, alcohol, acids, etc. Furthermore, this configuration makes it possible to use such a blocking device for the automatic closing of containers taking up liquid, in which closure is desired when a specific filling level is reached. If the liquid store is subsequently emptied, then because the sponge-like material dries out, hardening takes place with simultaneous resetting, which results in the valve being displaced back into the open position counter to the spring force. It proves to be particularly advantageous if, as preferred, the safety element can be separated from the vacuum cleaner attachment. The blocking valve is then arranged in the mouth region of the suction hose and assumes a blocking position when the hose is pulled off. As a result, the risk of sucking up liquid directly by means of the suction hose without the attachment is counteracted, since the blocking valve does not find any stop surface for displacement into the open position. Furthermore, the invention is distinguished by a low weight. This is in particular as a result of the fact that no pumps or the like are necessary.

The construction of the liquid applicator in the form of tufts of bristles has the further advantage that the bristles have a self-cleaning effect on account of the relative movement in relation to one another. A vacuum cleaner attachment, constructed as above, for the wet cleaning of surfaces has good acoustic and ecologically aligned properties and, in addition, can be produced cost-effectively. The vacuum cleaner attachment, in spite of the integration of liquid applicator, fresh liquid store and used liquid store, including a separator, is of small overall construction, which results in good handleability of the appliance. The size of the appliance attachment approximately corresponds to a normal window wiper. Good handleability of the appliance is improved, for the purpose of reaching areas located far away, in that it is provided according to the invention that a long handle, an extension pipe or the like can be fastened to it. To this end, an ergonomically designed handle is provided, which serves not only to accommodate the long handle or the like, but can also be used in order to clean easily accessible surfaces directly.

BRIEF DESCRIPTION OF THE DRAWINGS

With the above and other objects and advantages in view, the present invention will become more clearly understood in connection with the detailed description of preferred embodiments, when considered with the accompanying drawings of which, FIG. 7 shows a further alternative configuration, with triangular segmentation.

DETAILED DESCRIPTION OF THE PREFERRED EMBODIMENTS

Figure 1:
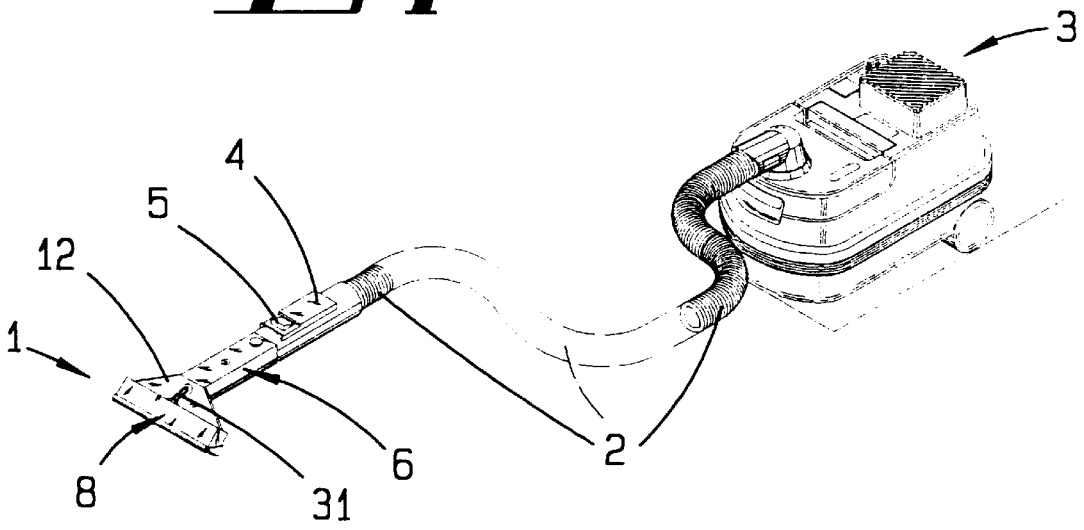
FIG. 1 shows a cylinder vacuum cleaner provided with a vacuum cleaner attachment according to the invention for the wet cleaning of surfaces, in a reduced perspective illustration.
Figure 2:
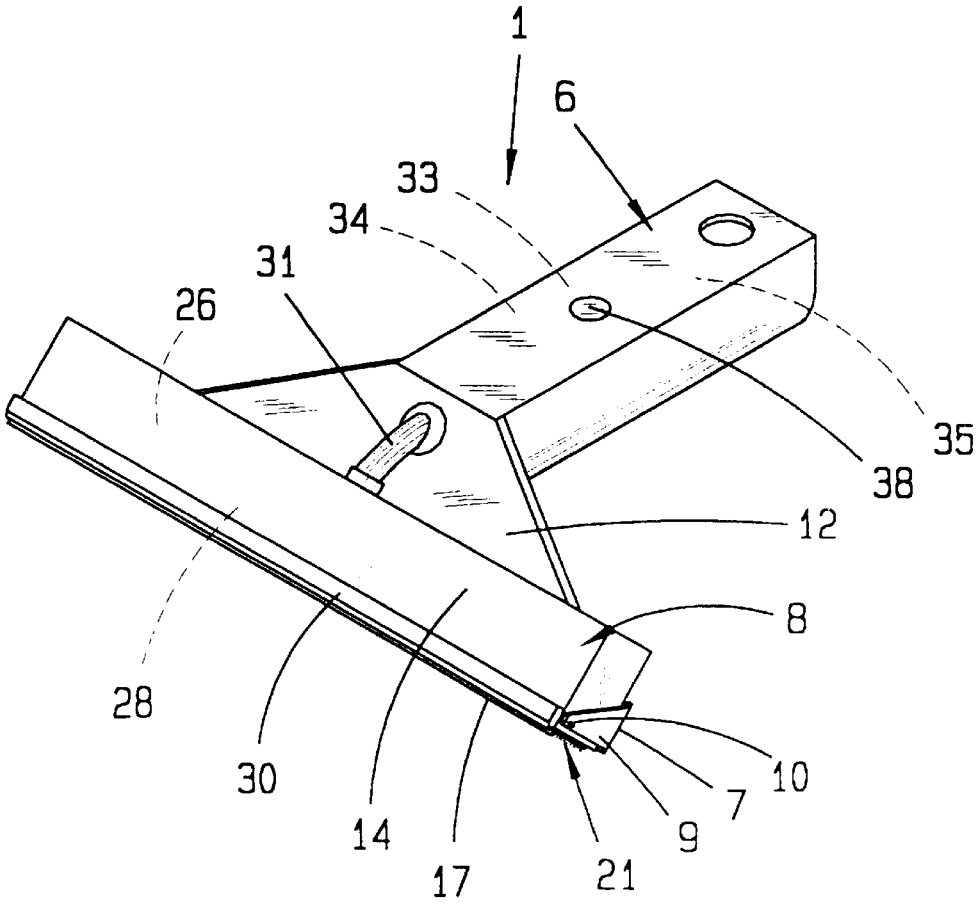
FIG. 2 shows the vacuum cleaner attachment in a perspective detail illustration.

Shown in FIG. 1 is a vacuum cleaner attachment 1, which is connected via a suction hose 2 to a vacuum cleaner 3. The vacuum cleaner attachment 1 is arranged at a handle 4, which is connected at the end to the suction hose 2. The securing of the vacuum cleaner attachment 1 to the handle 4 is performed via a coupling, not shown in more detail. In order to switch the vacuum cleaner 3, an on/off switch 5 is provided in the handle 4.

The vacuum cleaner attachment 1 is essentially composed of two housing parts. The first housing part is a coupling housing 6, which can be coupled to the handle 4 of the vacuum cleaner 3. Provided on this coupling housing 6, on the side opposite to the coupling end, is a U-shaped carrier 7, for the pivotable mounting of the second housing part, formed as working holder 8.

The coupling housing 6 is of bevelled construction in the end region having the carrier 7, to be specific at an angle of about 45°. The U-legs 9 of the carrier 7 are aligned at an angle of about 90° to the surface formed by the bevel, the carrier 7 projecting beyond the coupling housing 6 on both sides and running at right angles to the axis of the body of the coupling housing 6. In their free end region, the U-legs 9 have bearing pins 10, which engage into the housing of the working holder 8.

The working holder 8 is of rectangular shape in cross-section. In a basic position according to FIGS. 3 and 4, the working holder 8 is aligned such that the underside 11 runs parallel to the bevelled surface 12 of the coupling housing 6, but at a spacing from the latter.

Figures 3, 4:
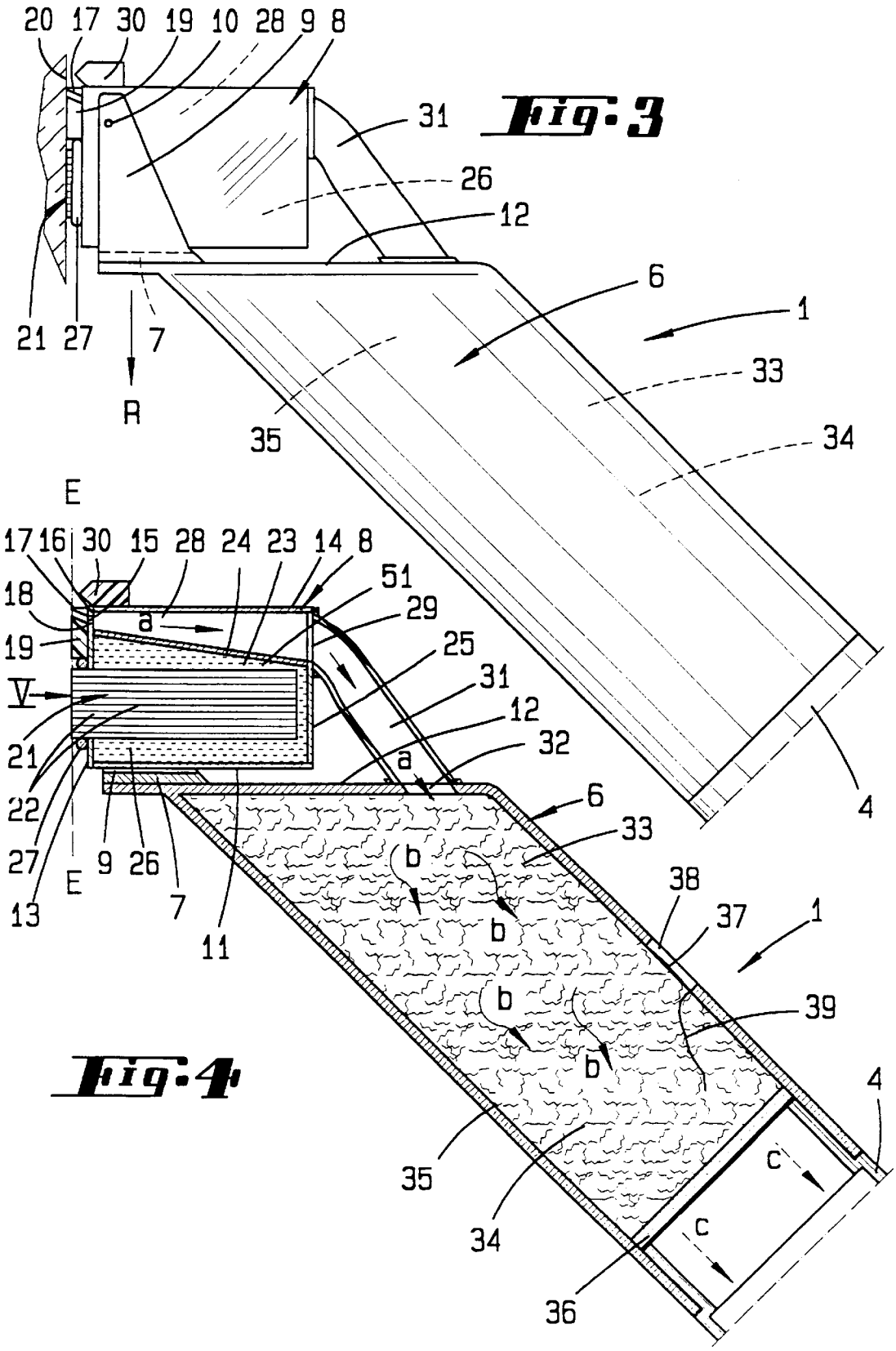
FIG. 3 shows the vacuum cleaner attachment according to FIG. 2 in a side view.
FIG. 4 shows a longitudinal section through the vacuum cleaner attachment.

The bevelled surface 12 of the coupling housing 6 is extended downwards, as can be seen from FIGS. 3 and 4, so that this surface projects beyond the underside of the coupling housing 6. The carrier 7 is located in the region of this projection. Accordingly, the working holder 8 also projects beyond the underside of the coupling housing 6, the bearing pins 10 engaging into the end region of the working holder 8 projecting beyond the coupling housing 6.

The front surface 13, facing away from the coupling housing 6, of the working holder 8 has a mouth 15 of a suction channel close to the upper side 14, that is to say close to the side facing away from the bevelled surface 12. The mouth 15 of the suction channel extends over virtually the entire width of the front surface 13 and is formed as a slit. At the front edge 16, facing the upper side 14, of the mouth 15 of the suction channel, an air-impermeable lip 17 is associated with the suction channel over the entire width. Provided on the rear edge 18, located opposite the front edge 16, is a cleaning element 19, in order to edge the mouth 15 of the suction channel. This cleaning element 19 comprises a sealing element with a cleaning nonwoven fabric applied to it, which fabric has a great mechanical interaction with the hard surface 20 to be cleaned. Alternatively, the sealing element may also be provided with bristles, felt or the like fitted to it.

Arranged upstream of the cleaning element 19, in the working direction R, is a liquid applicator 21. The latter comprises capillary elements in the form of bristles 22, applicator 21 extending in the form of a strip of tufts of bristles parallel to the cleaning element 19, to the mouth 15 of the suction channel and to the lip 17, virtually over the entire width of the working holder 8 (cf. FIG. 5).

The bristles 22 project beyond the front surface 13 of the working older 8, the tip of the lip 17, the front surface of the cleaning element 19 and the end surface formed by the strip of tufts of bristles lying on a common plane E.

The bristles 22 or the liquid applicator 21 extends into a liquid supply tank 23, which is bounded by a wall 24 arranged to be aligned in longitudinal extent in the working holder 8. The bristles 22 in this case extend up close to the rear surface 25, with a spacing from the latter. Provided in the liquid supply tank 23 is a capillary store 26, which preferably consists of wadding. This serves to supply the bristles 22 with a liquid 51 in any position of the vacuum cleaner attachment 1.

In order to avoid fraying of the ends of the bristles projecting freely beyond the front surface 13, a bristle holder 27 is provided, which clamps around the bristles 22 or the strip of tufts of bristles.

As already mentioned, the wall 24 provided in the working holder 8 bounds the liquid supply tank 23. Further defined by this wall is a suction channel 28 which, proceeding from the mouth 15 of the suction channel, extends transversely as far as the rear surface 25 of the working holder 8, at which rear surface 25 a suction channel opening 29 is provided at the centre.

Provided on the upper side 14 of the working holder 8, in the end region facing the front surface 13, is a residual water wiper 30, consisting of a commercially available material which absorbs water well, in which residual water is sucked up by capillary action. The said griper is accordingly arranged downstream of the lip 17 in the working direction R. As can be seen in FIGS. 3 and 4, the tip of the lip-like residual water wider 30 is set back relative to the plane. However, a configuration is also conceivable in which the tip lies on the common plane E.

The bearing pins 10, forming a hinge, by means of which the working holder 8 is secured to the coupling housing 6 via the carrier 7, are placed in such a way that the said bearing pins are located in the region between the lip 17 and the bristles 22 or the liquid applicator 21, as close as possible to the front surface 13 of the working holder 8.

A flexible suction hose 31, which can follow the pivoting movements of the working holder 8 about the bearing pins 10, opens in the region of the suction channel opening 29. This suction hose 31 forms a connection between the suction channel 28 and the coupling housing 6. To this end, an opening 32, which is arranged in the upper region of the bevelled surface 12, is provided in the bevelled surface 12.

The coupling housing 6, which is formed as a hollow body, contains a filter 33, which is likewise provided as a storage medium 34, in the form of an open-pore foam and/or active carbon. On the coupling side, the liquid store 35 formed is bounded by a water-impermeable and cleaning agent-impermeable, air-permeable membrane 36.

The storage medium 34, which has capillary properties, may furthermore consist of wadding, sponge, clay granules, paper or else of porous, sintered materials or materials produced by other processes. Furthermore, the storage medium 34 is configured in such a way that liquid droplets located on the membrane 36 are transported away from the membrane, by the capillary action of the storage medium 34, into the storage medium 34.

The take-up capacity of the storage medium 34 is monitored with the aid of a capillary-optical filling level indicator 37. Provided to this end on the upper side of the coupling housing 6 is a window 38, behind which there is situated a capillary sensor 39 projecting into the storage medium 34 and changing colour in dependence on the liquid loading.

Alternatively, the loading state may also be registered by means of a negative pressure switch, the negative pressure being registered on the suction side of the membrane 36. This negative pressure increases if a water film forms on the membrane 36. In this case, the suction of air and liquid is automatically interrupted, with the result that it is also not possible for liquid to drip out of the vacuum cleaner attachment 1 after the vacuum cleaner 3 has been switched off.

The application of water or cleaning agent to the hard surface 20 to be cleaned is effected by the capillary interstices of the bristles 22. However, liquid is only conveyed when the bristles 22 have contact with a surface. The conveying of liquid out of the capillary store 26 is likewise effected by means of capillary action.

The application of liquid and the sucking up of the liquid containing dirt is performed in one operation. The cleaning medium (preferably water, alcohols and/or surface-active substances) is applied to the surface 20 to be cleaned by means of the bristles 22 in amounts which, on the one hand, ensure a good cleaning effect but, on the other hand, prevent flow due to gravity. The amount needed for this is, according to the invention, about 3 to 10 g water per $m^2$ of hard surface. This thus permits large hard surfaces to be cleaned reliably with very small amounts of cleaning agent. Accordingly, the liquid supply tank 23 may also be of relatively small construction, preferably 30 to 150 ml. After the liquid 51 has been applied to the hard surface 20, with the movement of the vacuum cleaner attachment 1 in the working direction R, detachment of dirt by means of the cleaning element 19 is effected. The latter is preferably produced from a water-repellent material. In addition, the cleaning element 19, which also has a sealing element, seals off the suction channel 28 or its suction channel mouth 15 with respect to the bristles 22. By means of the lip 17, the cleaning agent/dirt mixture is drawn off from the hard surface 20 and, as a result of the high air velocity in the suction channel 28, is transported through the suction channel 29 and the flexible suction hose 31 into the storage medium 34 (arrows a). Any residual water 35 remaining on the hard surface 20 can be picked up automatically by means of the residual water wiper 30, as a result of the operation of moving the vacuum cleaner attachment 1 away, which is required at the end of the wiping operation.

The negative pressure produced at the mouth 15 of the suction channel may be used for the purpose of supporting the capillary transport of the cleaning medium out of the liquid supply tank 23. To this end, the amount of cleaning agent to be transported can be varied by the provision of a sealing element which is movable or is provided locally with openings between the mouth 15 of the suction channel and the liquid applicator 21 or the bristles 22.

As has already been mentioned, the suspension of dirt and cleaning medium is sucked away from the hard surface 20 to be cleaned by means of the connected vacuum cleaner 3 into the filter 33 or into the storage medium 34. Here, separation of dirt, cleaning medium and air takes place (arrows b). Accordingly, the dirt/cleaning medium suspension is separated. An air stream which is free of condensed material and at the same time carries small amounts of solid particles with it flows out of the vacuum cleaner attachment 1 (arrows c).

The air stream flowing through the filter 33 or the storage medium 34 may be used for the purpose of drying the dirt/cleaning medium suspension, with the result that the storage medium 34 stores only small amounts of liquid and can therefore be formed to be small in its dimensions. The storage medium 34, which consists at least of a porous medium, reliably holds back the condensed phase. As a result of the large surface of the storage medium 34, however, a large amount of cleaning liquid is transferred into the gaseous form as a result of interaction with the air stream, and is entrained.

In order to ensure reliable transport of the dirt/cleaning suspension, and to provide residue-free drying of the hard surface 20, according to the invention, air velocities of 30 to 90 m per second are realized in the suction region. To this end, it is advantageous to configure the flow channel in such a way that the above-mentioned local flow velocities are established with only low air volume flows of 3 to 15 l per second.

Furthermore, there is the possibility of feeding back the liquid stored in the storage medium 34 to the liquid applicator 21 or to the liquid supply tank 23. This may take place via capillary transport. However, in this case it is necessary for the introduction of suction air and the feeding back of liquid in the liquid store 35 to be separated physically from each other to such an extent that the liquid fed back is at least adequately cleaned of the dirt particles carried in the sucked-in air. The high negative pressure produced at the mouth 15 of the suction channel may be used for this back transport. A closed circulation is formed, whereby large hard surfaces may be cleaned with very small amounts of cleaning media. The vacuum cleaner attachment 1 is in this case to be configured in such a way that the negative pressure in the region of the mouth 15 of the suction channel is greater in terms of magnitude for any position of use of the vacuum cleaner attachment 1 than the negative pressure upstream of the storage medium 34, plus the pressure drop in the filter 33, in the used water tank 35 and in the capillary medium 34.

In order to achieve a further increase in the cleaning effect, solid additives such as spherical, fiber-like particles and the like may be added to the cleaning medium stored in the capillary store 26.

Figures 4, 5, 6:
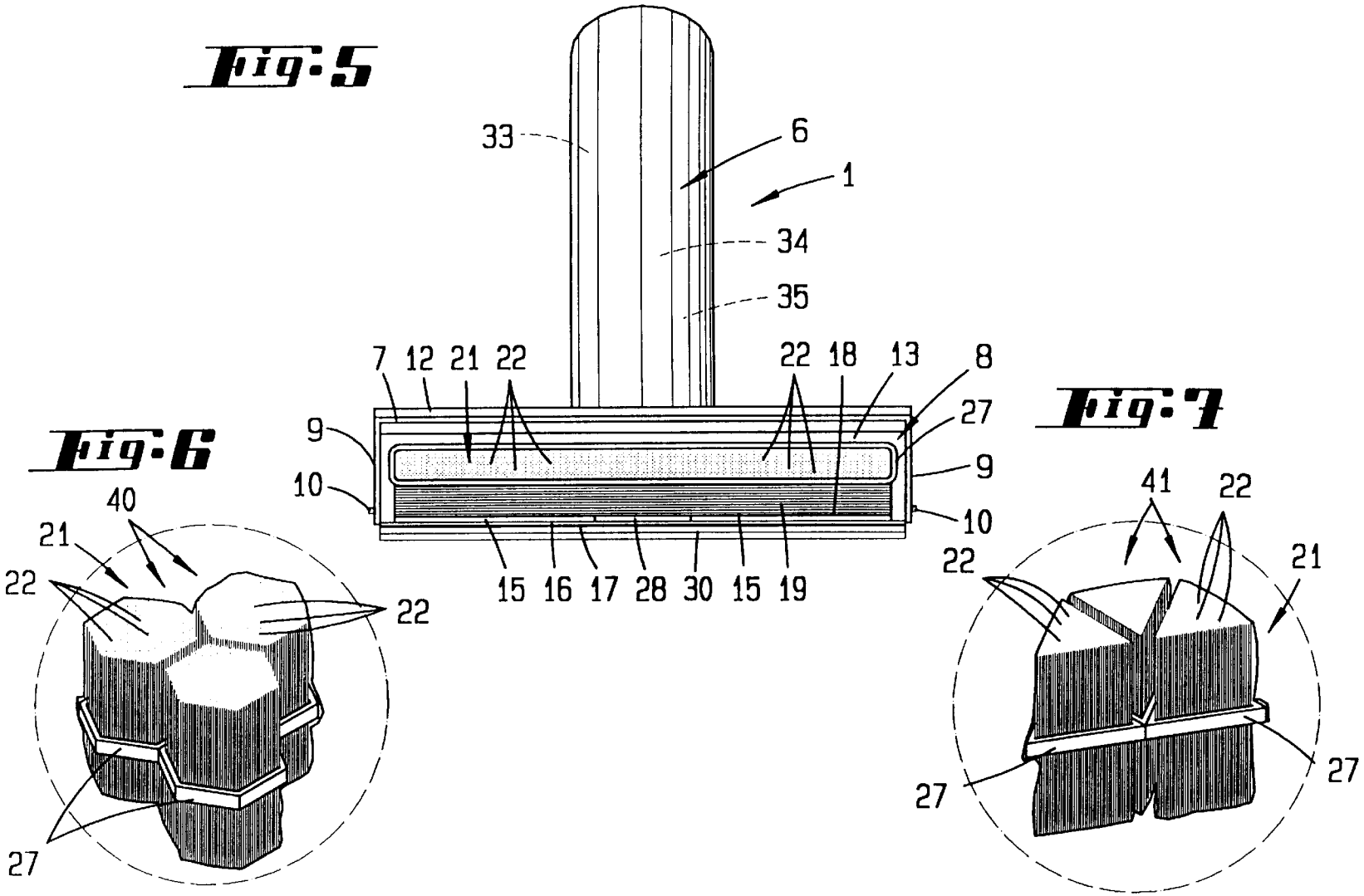
FIG. 5 shows a front view according to arrow V in FIG. 3 of a working holder of the vacuum cleaner attachment.
FIG. 6 shows an alternative configuration of a liquid applicator illustrated in FIG. 5, here the applicator being subdivided with respect to the applicator surface into honeycomb structures.
Figure 8:
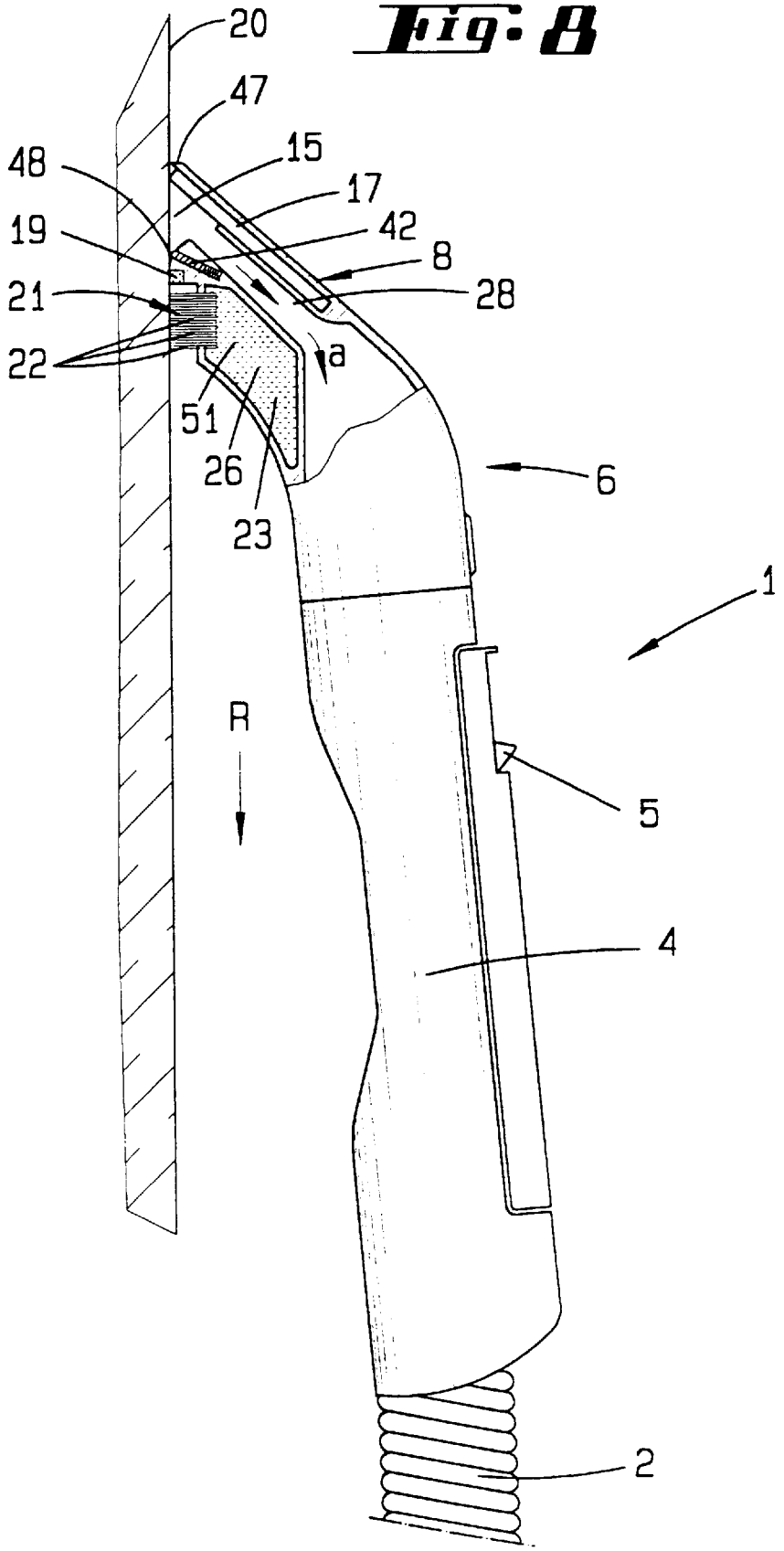
FIG. 8 shows a further embodiment of the subject-matter of the invention in a partially cut-open side view.

As illustrated in FIG. 5, the liquid applicator 21 may be formed as a strip of tufts of bristles, which consists of closely clamped individual bristles 22. Alternative configurations are illustrated in FIGS. 6 and 7. Here, the strip of tufts of bristles is subdivided, this subdivision being executed in such a way that a continuous strip of tufts of bristles is approximated. This is achieved in FIG. 6 by a honeycomb-like arrangement of tufts of bristles 40. In FIG. 7, this is realised by a triangular arrangement of tufts of bristles 41.

Two further embodiments of the subject-matter of the invention are illustrated in FIGS. 8 to 15. The way in which they function is identical to the embodiment previously described. Here, only alternative configurations of the edge of the mouth of the suction channel are illustrated.

Firstly, with reference to FIGS. 8 to 12, a vacuum cleaner attachment 1 is illustrated which has a suction channel mouth 15 of which the edge 42 facing the liquid applicator 21 can be moved out. This edge 42 of the mouth of the suction channel is arranged downstream in the working direction R of the liquid applicator 21 and of the cleaning element 19, and can be moved, for example in the suction direction. To this end, the edge 42 is formed as a strip which is arranged movably in a correspondingly shaped groove-like receiver 43, which is open in the direction of the surface to be worked on. Furthermore, compression springs 44 are provided in the receiver 43, which effect automatic outwards displacement of the edge 42, with the result that the edge 42 is always in contact with the surface 20 to be cleaned, up to a specific angle of attack of the vacuum cleaner attachment 1. At its free edge, pointing in the direction of the hard surface 20 to be cleaned, the edge 42 is of comb-like construction. To this end, tooth-like projections 45 are integrally moulded at the marginal edge, between which projections 45 clearances are formed, in order to define closely bounded suction channels 46 (for this, cf. FIG. 12).

This comb construction of the rear edge 42, preferably consisting of a commercially available, water-repellent plastics, of the mouth 15 of the suction channel offers improved sucking up of the dirt/cleaning medium suspension during cleaning of hard surfaces 20, since the air velocity is increased as a result of the closely bounded suction channels 46. The front edge of the mouth of the suction channel is in this case formed by the air-impermeable lip 17.

In order to remove residual water and dirt from the hard surface 20 before completing the cleaning operation, the vacuum cleaner attachment 1 is firstly tilted away from the hard surface 20 in such a way that the liquid applicator 21, the cleaning element 19 and the lip 17 lose their effect. Because of this, the edge 42 moves out of the receiver 43 as a result of the spring force of the compression springs 44, and continues to define a rear edge 48 of the mouth 15 of the suction channel, the edge 42 engaging on the hard surface 20 by means of its projections 45. The opposite edge of the mouth 15 of the suction channel is now formed by a front edge 47, likewise of comb-like construction, which is provided on the lip 17, to be specific on the rear side of the lip 17, as viewed in the working direction R.

As a result of tilting the vacuum cleaner attachment 1, firstly the supply of liquid is interrupted as a result of lifting the liquid applicator 21 from the hard surface 20. In this case, the mouth 15 of the suction channel continues to engage on the hard surface 20, this with its edge 42, which has been moved out, and with its front edge 47, likewise of comb-like construction. By this means, closely bounded suction channels 49 and 46 are formed both on the front edge 47 and also on the rear edge 48 and on the edge 42. As a result of this configuration, the air is sucked through the closely bounded suction channels 46 and 49 at high velocity, as a result of which residual water, which is still on the hard surface 20, is atomized. This atomization of residual water can additionally be improved by sharp flow edges and deflections directly downstream of the comb-like constructions of front edge 47 and rear edge 48. After the atomization of the residual water, the vacuum cleaner attachment 1 may be removed from the hard surface 20.

Figures 13, 14:
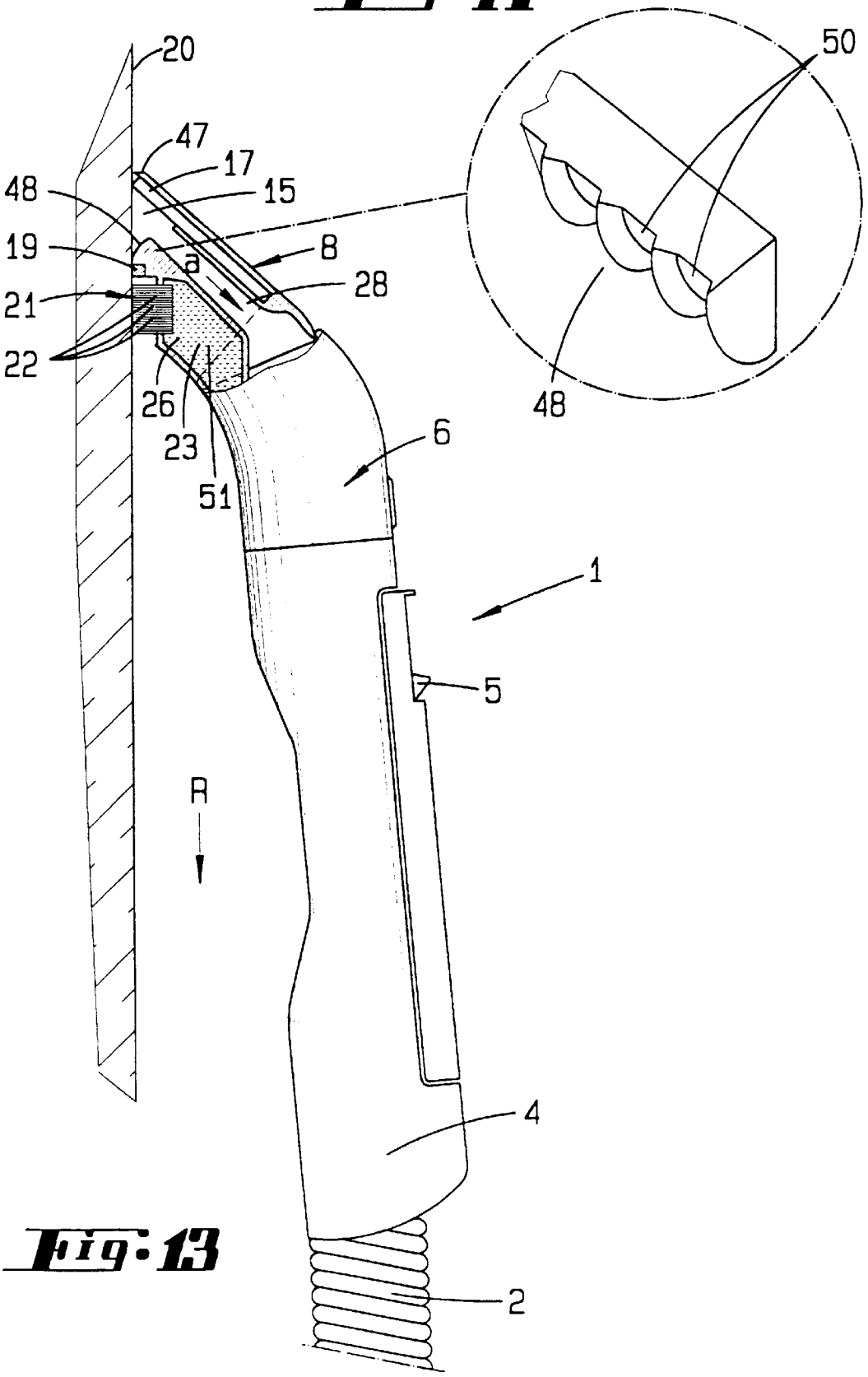
FIG. 13 shows a further embodiment of the vacuum cleaner attachment, likewise in a partially broken-open side view, in the working position.
FIG. 14 shows a perspective detailed illustration of the rear edge of the suction channel mouth in an alternative configuration.
Figure 15:
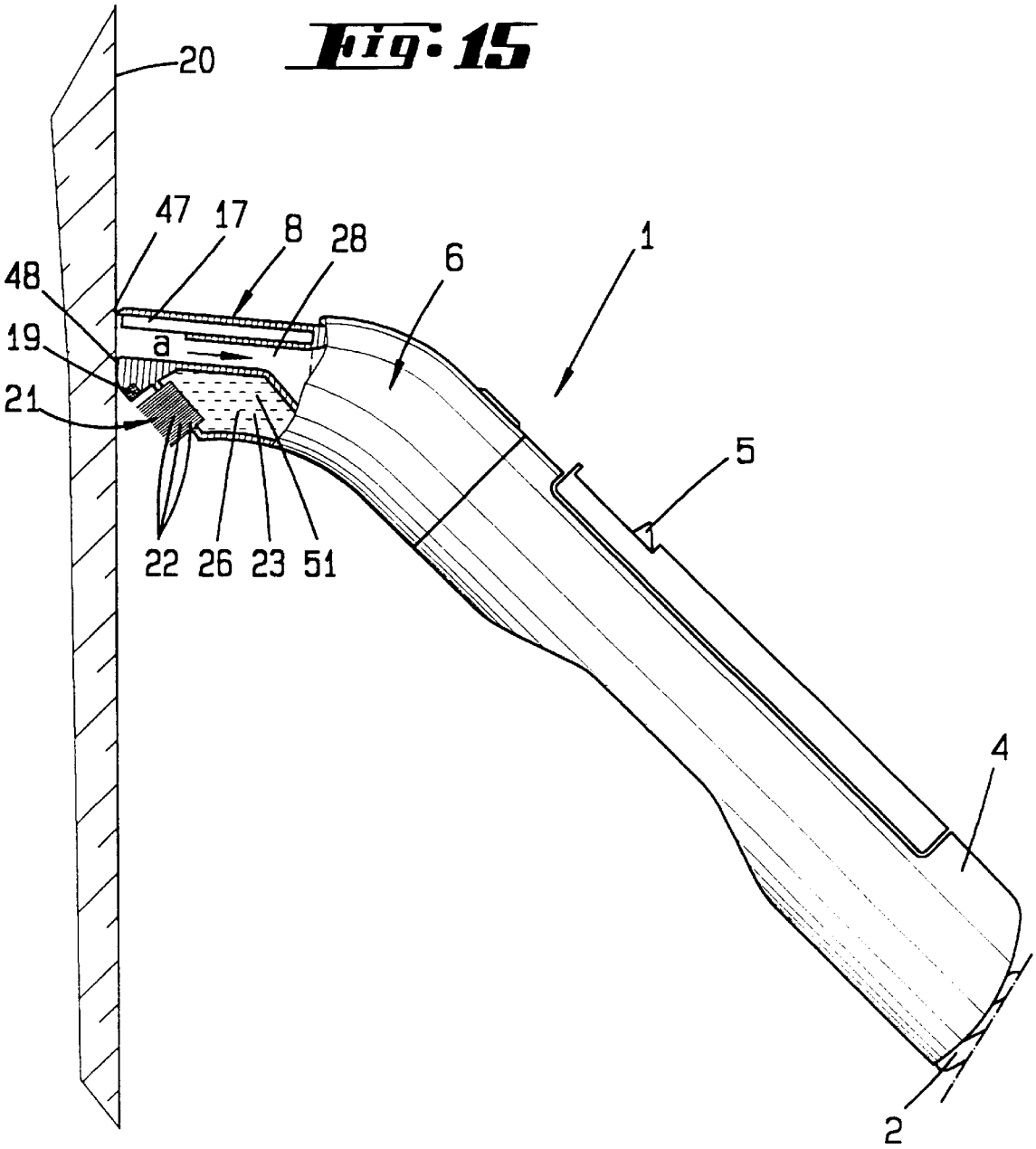
FIG. 15 shows the vacuum cleaner attachment according to FIG. 13 in a position tilted away from the surface to be cleaned.

A further embodiment is illustrated in FIGS. 13 to 15. This differs from the exemplary embodiment previously described in that the lip 17, together with the comb-like front edge 47 associated with it, is mounted such that it can pivot with respect to the rest of the working holder 8, and in that the edge 42 or the rear edge 48 of the mouth 15 of the suction channel is realised as a static component which, in order to form closely bounded suction channels 50, has a plough-like construction of the marginal edge pointing in the direction of the hard surface 20.

The comb-like and plough-like constructions of the front edge 47 and rear edge 48 do not come into effect in a normal working position (see FIG. 13), just as in the exemplary embodiment previously described. When the vacuum cleaner attachment 1 is tilted away in accordance with the position in FIG. 15, only the comb-like front edge 47 and the plough-like rear edge 48 make contact with the hard surface 20, as a result of which atomization of residual water also takes place once more here, caused by the closely bounded suction channels in the region of front edge 47 and rear edge 48.

Figure 9:
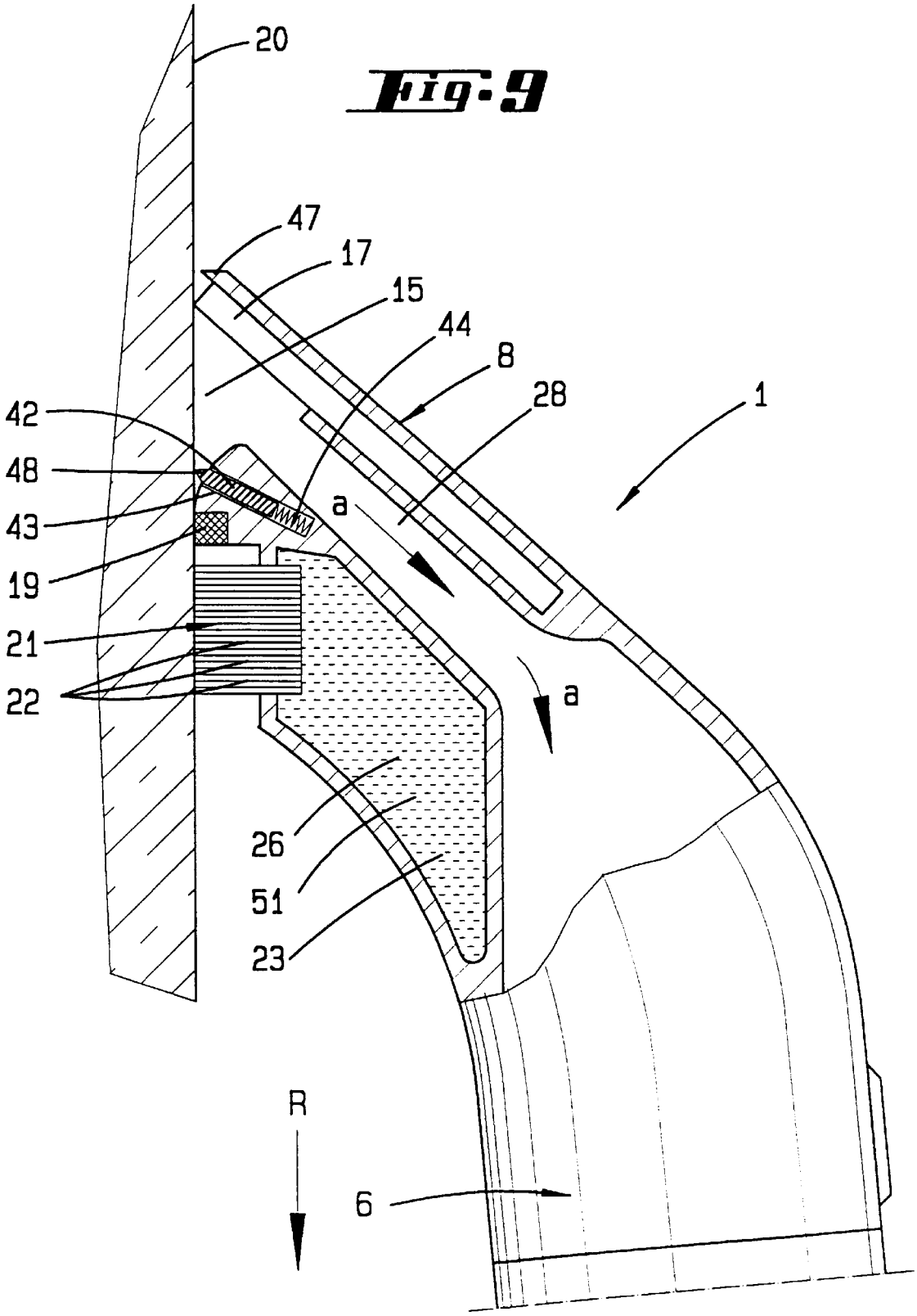
FIG. 9 shows the partially broken-open region of FIG. 8 in an enlarged illustration.
Figures 10, 11, 12:
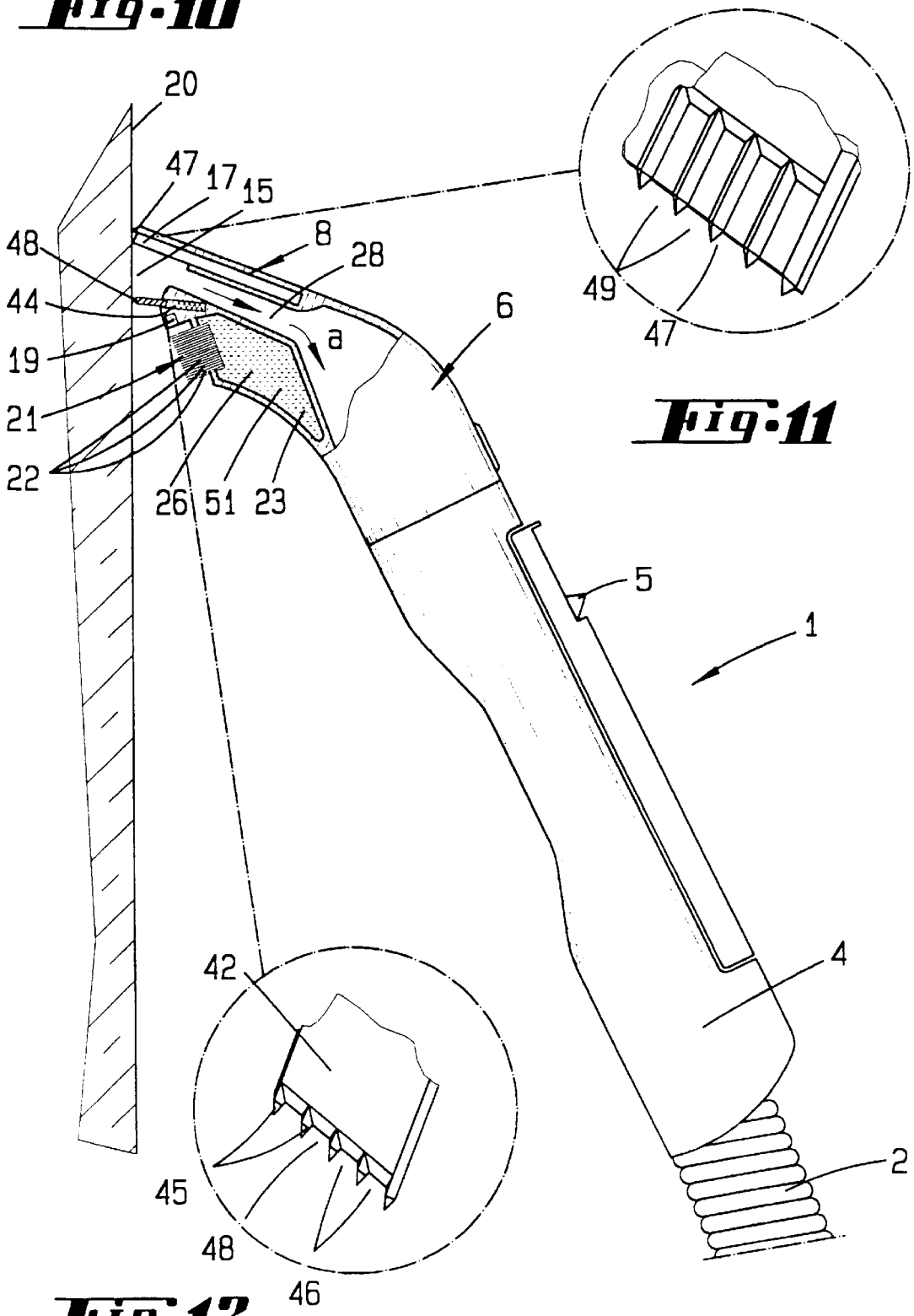
FIG. 10 shows the subject-matter according to FIG. 8, but in a position tilted away from a surface to be cleaned.
FIG. 11 shows a perspective detailed illustration of a front edge of a suction channel mouth.
FIG. 12 shows a further perspective detailed illustration relating to the rear edge of the mouth of the suction channel, the latter being able to be moved out.
Figure 16:
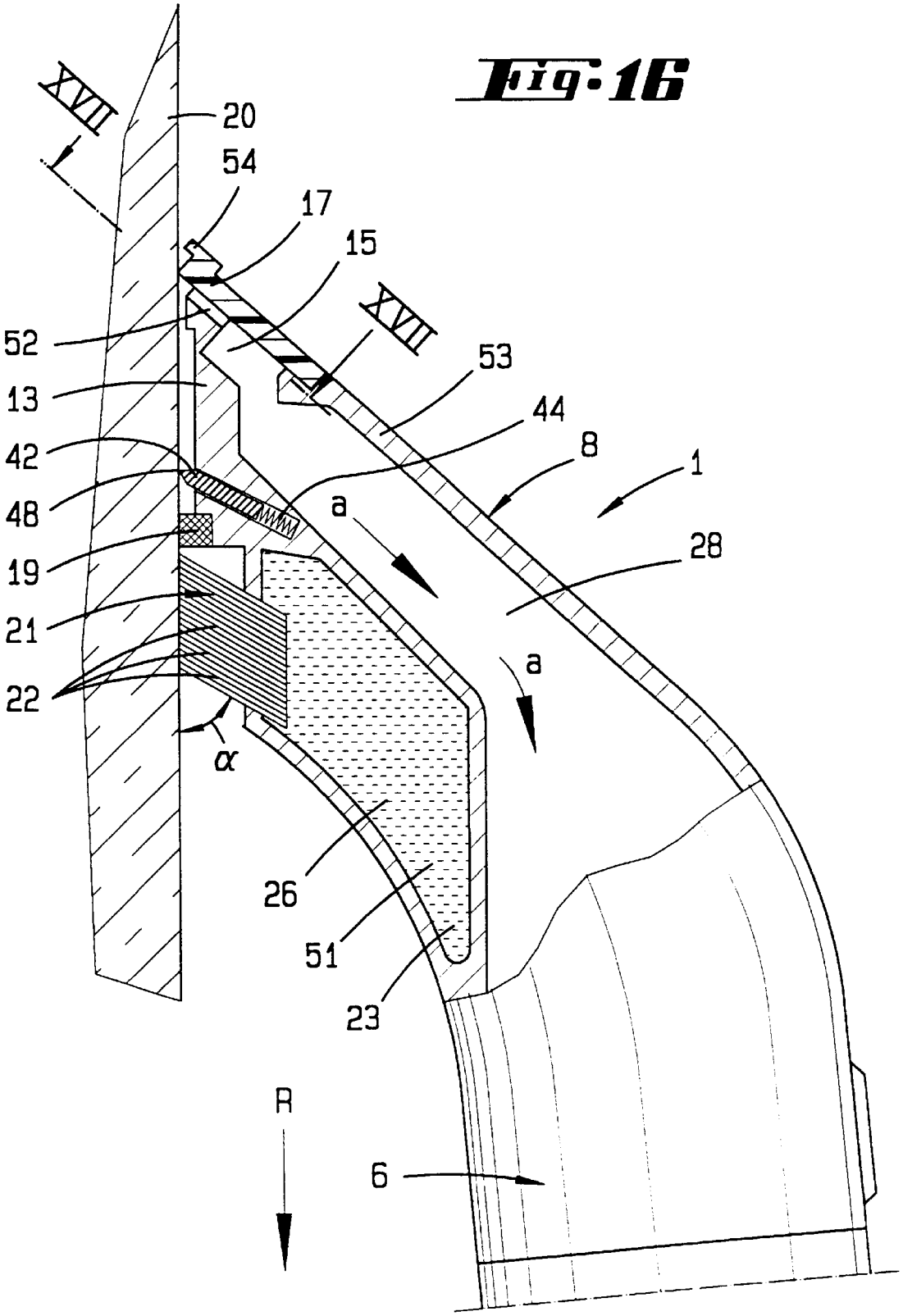
FIG. 16 shows an illustration corresponding to FIG. 9, but relating to a further embodiment.

A further embodiment of the vacuum cleaner attachment 1 according to FIG. 9 is illustrated in FIG. 16. It can be seen that the bristles 22 emerging from the capillary store 26 are arranged in such a way that they include an angle alpha of about 60° with the surface 20 to be cleaned. However, constructions are also conceivable in which an angle alpha of about 30–60° is provided.

The selected arrangement of the bristles 22 in this case proves to be advantageous to the extent that, in the course of drawing the appliance attachment 1 on the surface 20 to be cleaned, the said bristles adapt to the surface 20 to be cleaned virtually over the entire bristle surface, as a result of slight lateral bending in the direction opposite to the working direction R, and thus compensate, for example, for production tolerances and irregularities on the surface 20 to be cleaned.

Furthermore, an alternative configuration of the mouth 15 of the suction channel can be seen. Here, the suction region is formed in such a way that a multiplicity of suction channel sections 52 in the form of spur channels proceed from the mouth 15 of the suction channel. These suction channel sections 52 are distributed uniformly over the entire appliance width or over the entire longitudinal extent of the mouth 15 of the suction channel, and preferably have a U-shaped cross-section. The suction channel sections 52 are formed in the region of a freely projecting end of the front face 13, forming the bottom region, U-shaped channel boundaries being provided thereby on the appliance housing side.

Furthermore, the suction channel sections 52 are bounded by the lip 17, whereby spur channels are formed.

Figure 17:
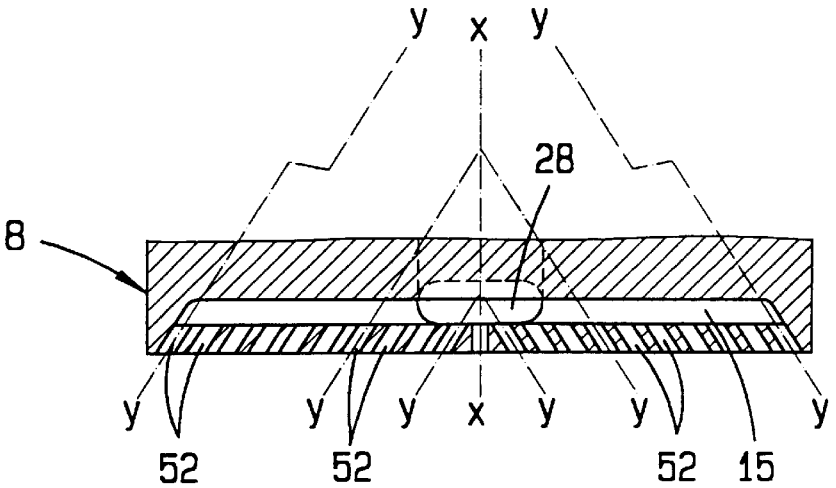
FIG. 17 shows the section according to the line XVII—XVII in FIG. 16.

This configuration offers improved suction. This is still further optimized by the suction channel sections 52 being arranged to run obliquely in such a way that they run at an angle towards the suction channel 28. This angled run of the suction channel sections 52 can be seen in the cross-sectional illustration in FIG. 17. The suction channel sections 52 are arranged symmetrically about a main axis x—x, with respect to their inclination, which main axis x—x simultaneously forms the central axis of the suction channel 28. The inclination of the suction channel sections 52 is selected such that central axes y of the sections 52 intersect the main axis x of the suction channel 28, this preferably occurring within the body of the vacuum cleaner attachment. In the exemplary embodiment shown, the axes y of the suction channel sections 52 include an angle of about 30° with respect to the main axis x. However, constructions are also conceivable in which an angle of 30–60° is included.

In the course of a cleaning operation, the construction of such suction channel sections 52 which, starting from the mouth 15 of the suction channel, extend as far as the region of the lip 17, formed as a drawing-off rubber, has the advantage that immediate drying of the drawing-off rubber or of the lip 17 is achieved, as a result of which water streaks are prevented if the lip region of the vacuum cleaner attachment 1 is applied once again, for example on window panes. Furthermore, a construction of this type improves the take-up of water by the suction at small air volume flows, as a result of very high air velocities in the suction channel sections 52, on account of the small cross-sections. Furthermore, the obliquely running arrangement of the sections 52 has the effect of aligning the air volume flow in the direction of the suction channel 28.

The operation of moving the lip 17 away, for example at edges in the case of window frames, proves to be particularly critical, since here the lip 17 is to some extent severely bent. The result of this is that the cleaning liquid is not always completely drawn off from the surface to be cleaned. As a result, streaks may form at these points, in particular on window panes.

According to the invention, this problem is solved in that the lip 17 is formed as a double lip.

As can be seen from FIG. 16, the lip 17 is constructed in prolongation of a housing wall 53 bounding the suction channel 28, the lip 17 in turn forming the boundary of the mouth 15 of the suction channel and of the suction channel sections 52.

Figure 18:
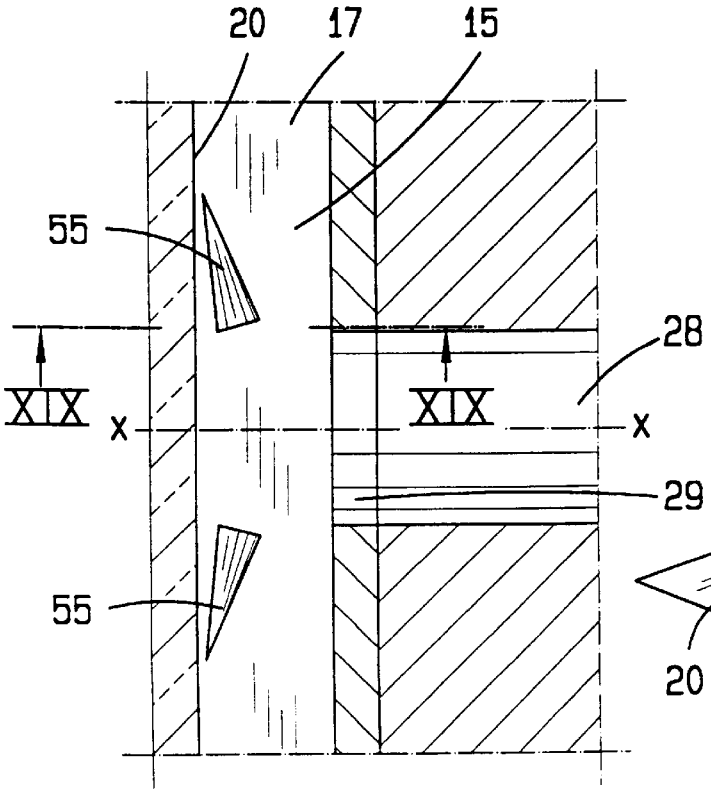
FIG. 18 shows a detail enlargement of the region of a sealing lip resting on a surface to be cleaned, viewed on the inside of the lip.

Viewed in the working direction R, an outer, second lip 54 is arranged downstream of the lip 17, and preferably consists of a material which is softer than the inner, original lip 17. In this case, the arrangement is such that the outer lip 54 is located at a spacing from the surface 20 to be cleaned during a working operation (cf. FIG. 16). The result of this is that, during a normal cleaning operation, this lip 54 does not come into contact with the surface 20 to be cleaned. In the course of the operation of removing the vacuum cleaner attachment 1, the latter is angled, as already mentioned, the second lip 54 coming into contact with the surface 20 to be cleaned and thereby, for example in the region of a window frame, further additionally drawing off the window pane, In order to reduce or even eliminate any amount of residual water remaining on the surface 20 to be cleaned, in a further refinement the air-impermeable lip 17 is provided with channels 55 in the region of contact with the surface 20 to be cleaned (cf. FIG. 18). These channels are provided on the side of the lip 17 facing the liquid applicator 21 and accordingly the mouth 15 of the suction channel, and run substantially in the width direction of the lip 17. These channels 55 have an acute-angled triangular shape in plan view and are arranged close to the region of the suction channel opening 29.

Figure 19:
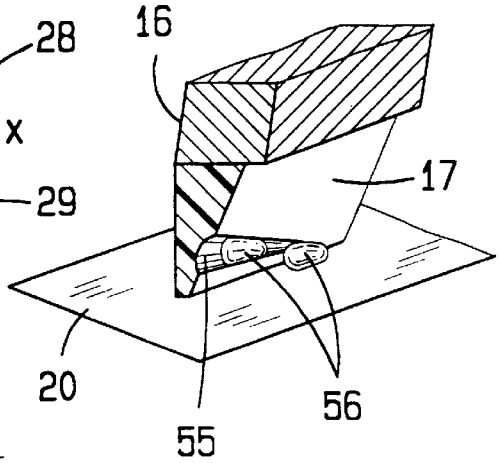
FIG. 19 shows the section according to the line XIX—XIX in FIG. 18, but in a perspective illustration.

The channels 55 are thereby aligned in such a way that their tips are located close to the region of contact with the surface 20 to be cleaned, so that these tips face away from the main axis x passing through the suction channel 28. In cross-section, these channels 55 have a segment shape, the depth increasing from the tip in the direction of the main axis x (for this, cf. the perspective illustration in FIG. 19).

As a result of this configuration, in particular as a result of the shape of the channels 55, different capillary pressures are achieved, with the result that residual water 56 is transported by the pressure gradient towards the suction channel 28 and is therefore entrained by the air volume flow.

Figure 20:
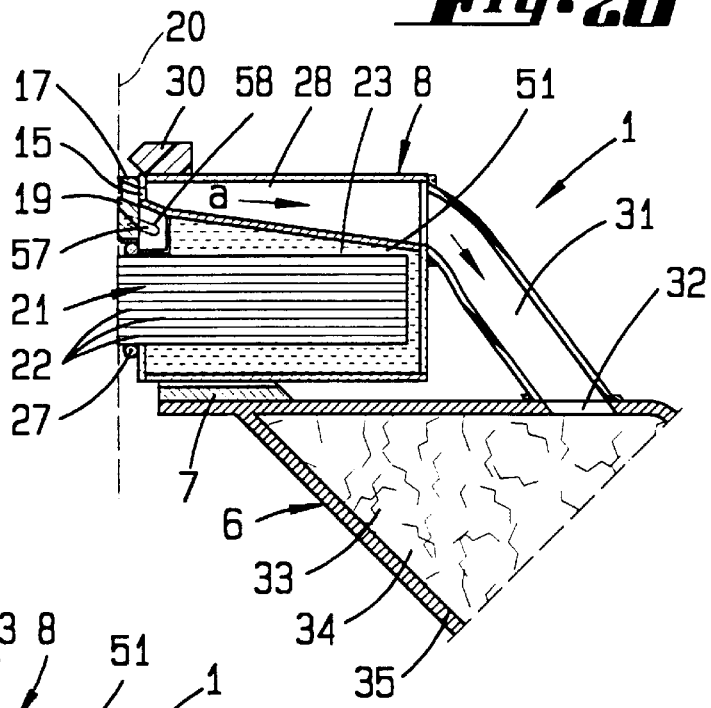
FIG. 20 shows a detailed illustration of the illustration according to FIG. 4, but relating to a further embodiment.
Figure 21:
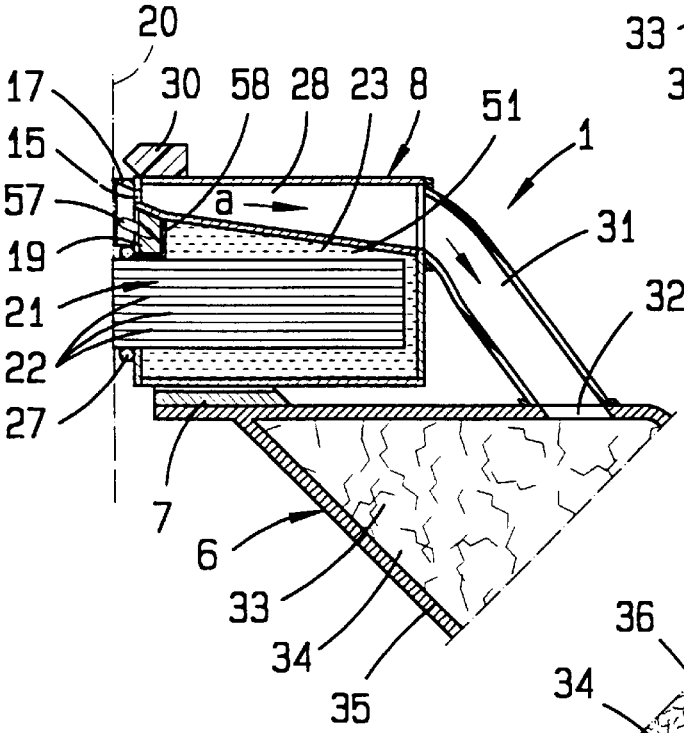
FIG. 21 shows an illustration corresponding to FIG. 20, but following the displacement of a cleaning element away from the surface to be cleaned.

The working holder 8 of the vacuum cleaner attachment 1 according to FIG. 4 is illustrated in a further embodiment in FIGS. 20 and 21. It can be seen that here the cleaning element 19 is arranged to be displaceable in such a way that the cleaning element 19 can be displaced back from a normal position, acting on the surface 20 to be cleaned (see FIG. 20) into a position which enlarges the cross-section of the mouth 15 of the suction channel (see FIG. 21). To this end, for example, the cleaning element 19 may be mounted by means of pins in slots 57 and can be displaced by the user by means of a handle, not shown. In this case, a chamber 58 which can accommodate the cleaning element 19 in a displaced-back position is provided.

By means of this configuration, in particular in the case of particularly stubborn contamination or in other cases where an increased amount of cleaning agents have to be applied to the surface 20 to be cleaned, the negative pressure that is present in the suction channel 28 can be used in order to increase the cleaning medium volume flow in the liquid applicator 21. As a result of the displacement of the cleaning element 19 into the chamber 58 depicted, the spatial separation between the mouth 15 of the suction channel and the liquid applicator 21 is dispensed with, so that at the latter a negative pressure with respect to the environment prevails, as a result of which more cleaning liquid is delivered through the capillary applicator.

It is also conceivable to provide the spatial separation by means of another appliance part, which is arranged so as to be displaceable in order to increase the cleaning agent volume flow.

In order to rule out completely any risk to the user, for example as a result of electrical short-circuits, the cleaning liquid 51 must not pass in condensed form to live parts of the vacuum cleaner 3 needed for the suction. According to the invention, this can be achieved in that a moisture sensor is provided at a suitable point on the vacuum cleaner attachment 1, for example directly upstream of the interface to the vacuum cleaner 3, which sensor immediately interrupts the voltage supply upon contact with condensed cleaning liquid. Moisture sensors of this type are commercially available.

Figure 22:
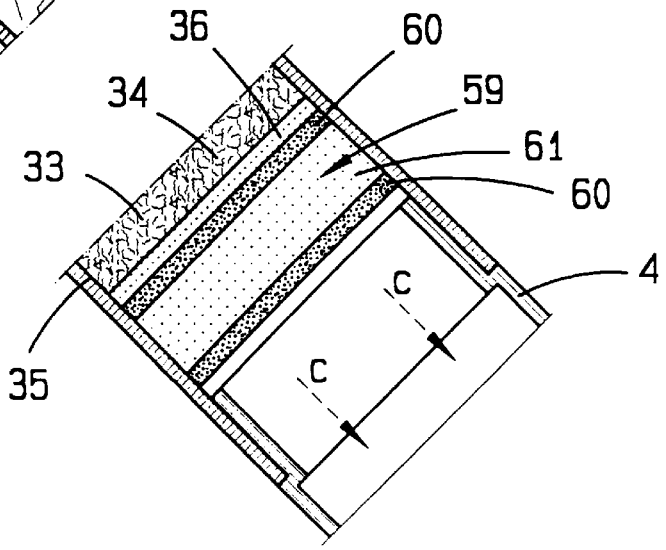
FIG. 22 shows a further detail representation from FIG. 4, showing a safety element arranged downstream of a liquid-impermeable membrane.

In a further construction, instead of or as a supplement to the liquid-impermeable membrane 36, use may be made of an element which binds the condensed cleaning fluid. This is illustrated in FIG. 22, with reference to an exemplary embodiment.

Here, a safety element 59 is located downstream of the membrane 36 in the flow direction, this taking place directly in the region of the interface to the vacuum cleaner 3.

The safety element 59 has a swelling material 61 embedded between two porous walls 60.

The safety element 59 is part of the liquid store 35, the swelling material 61 being provided in such a way that it changes in the sense of increasing volume in the event of taking up liquid. This binding of condensed liquids may take place chemically or chemo-physically. As already mentioned, in a preferred embodiment, the water-binding medium 61 is embedded in a porous cavity. Known, water-binding media are, for example, high molecular weight, industrial substances, such as polyacrylate or the like, or else natural products such as potato starch.

As a result of the filling of the safety element 59 with a swelling material 61, a separate flow path is provided in which—as a result of the large surface formed in this way of the swelling material in order to pick up condensed moisture—a safeguard is provided in order to rule out completely any risk to the user. Any moisture which passes through is picked up by the water-binding media, the latter changing their state on contact with the condensed liquid, in the form of swelling up, with the result that a large pressure drop is produced at the swelling material 61 and the air volume flow finally comes to a standstill with an increase in the amount of water. By this means, the transport of condensed material into the vacuum cleaner 3 is ruled out.

Accordingly, this produces a device which controllably triggers the suction in dependence on a specific filling level of the liquid store 35. In a further embodiment of the subject-matter of the invention, the increase in volume of water-binding media, in particular swelling material 61, may advantageously be used inasmuch as the air volume flow, which is mixed with condensed moisture, is led through a gap whose wall consists of water-binding materials.

Figure 23:
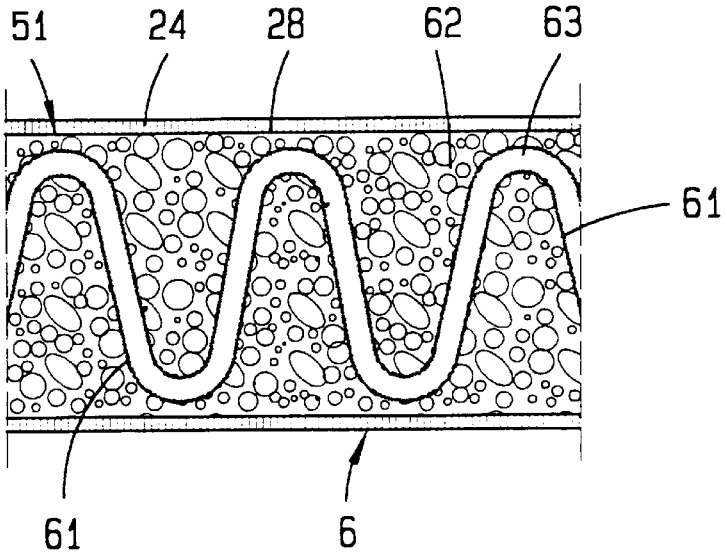
FIG. 23 shows a schematic illustration of a further safety element.

An arrangement of this type is shown in a schematic illustration in FIG. 23. Provided in the region of the suction channel 28 is a core 62 which closes the latter and is made, for example, of closed pore foam, which core leaves only a separate flow path 63 of alternating direction. This extensive alternation of direction of the flow path 63 serves the purpose of forming a relatively large surface, the wall of the separate flow path 63 consisting partially or, as is preferred, completely of the swelling material 61. The air, which is penetrated by condensed moisture, flows through the flow path 63, the increase in volume of the water-binding medium (swelling material 61) reducing the gap width of the flow path 63, when condensed liquid occurs, down to a complete interruption of the air volume flow, as a result of which risk to the user is also ruled out here.

A configuration of this type may also be connected downstream of the water-impermeable membrane 36 as an additional safety element.

Figure 24:
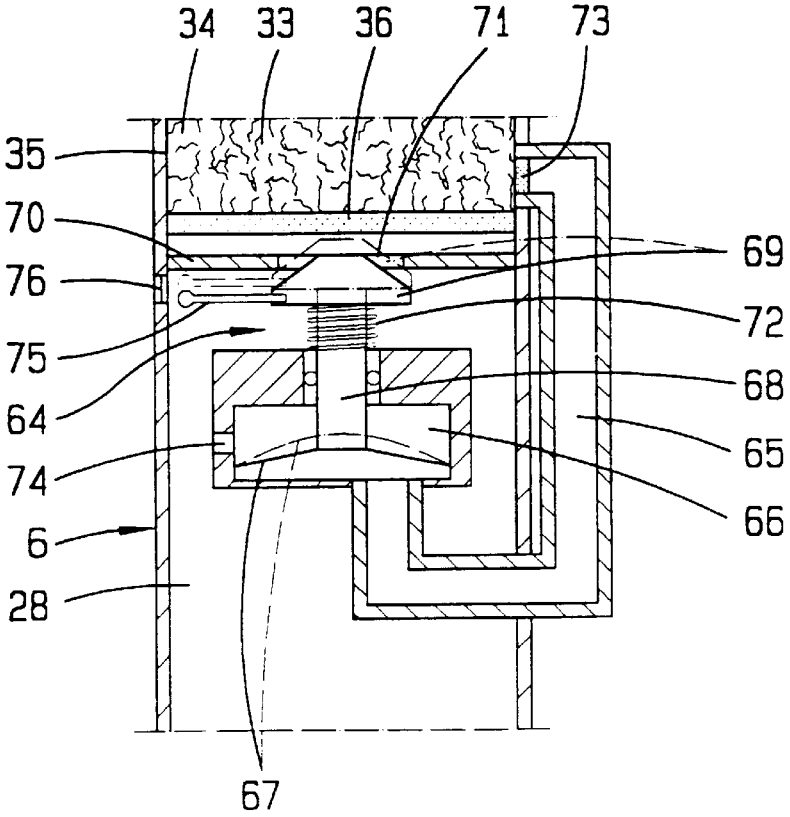
FIG. 24 shows, in a further alternative configuration, a safety valve arranged downstream of the membrane.

In order to reduce the liquid retaining pressure at the membrane 36, a safety valve 64 may furthermore be provided, which is located downstream of the membrane 36 in the flow direction (cf. FIG. 24). To this end, a pressure balancing channel 65 is provided which at one end—viewed in the outflow direction—is connected upstream of the membrane 36 and at the other end is connected to a pressure chamber 66 provided in the interior of the suction channel 28. Located inside this pressure chamber is an elastic membrane 67, to which a plunger 68 with a sealing cone 69 fitted at the top is secured. The said cone acts in the direction of the water-impermeable membrane 36 of the liquid store 35. In this case, a construction is preferred in which the sealing cone 69 consists of rubber.

Provided coaxially with the water-impermeable membrane 36, downstream of the latter in the flow direction, is a blocking wall 70 which has an axial opening 71.

Provided between the pressure chamber 66 and the sealing cone 69 is a tension spring 72, which surrounds the plunger 68 and which holds the sealing cone 69, together with the plunger 68, in an open position of the axial opening 71.

The entry opening of the pressure balancing channel 65 in the region of the liquid store 35 close to the membrane 36 is preferably likewise closed by a water-impermeable membrane 73. Furthermore, the pressure chamber 66 has a pressure balancing opening 74 in that region of the elastic membrane 67 located opposite the entry region of the pressure balancing channel 65. As a result of this configuration, the elastic membrane 67 is loaded on one side by the pressure prevailing upstream of the liquid-impermeable membrane 36 and on the other side by the pressure of the suction channel 28.

During normal operation, that is to say at a low or medium filling of the liquid store 35, the pressure difference is low, so that the force of the tension spring 72 leaves the sealing cone 69 in an open position. However, as soon as the filling level of the liquid store 35 approaches a maximum, the pressure difference increases accordingly, for example because a water film forms on the water-impermeable membrane 36. As a result of this pressure difference, a displacement of the sealing cone 69 in the direction of the axial opening 71 takes place, as far as complete closure of this opening 71, as a result of which the air volume flow is interrupted and accordingly the water-impermeable membrane 36 is relieved (for this, see the dashed illustration in FIG. 24).

In this closed position, the front face of the sealing cone 69 can additionally serve to support the membrane 36, in order to relieve the latter further here as well.

This type of configuration has the particular advantage that the membrane 36 has to withstand a lower liquid retaining pressure than without the use of a safety valve, since above an adjustable pressure difference, the safety valve 64 closes and the membrane 36 is relieved. This provides for the use of the vacuum cleaner attachment 1 on virtually all commercially available vacuum cleaners, even those which are not suitable to suck up condensed liquid.

By means of a simple indicator coupled mechanically to the safety valve 64, it is also possible to indicate to the user that the liquid store 35 is charged to a maximum and that the latter has to be exchanged or has to be regenerated. To this end, for example—as illustrated schematically in FIG. 24—a pointer 75 may be provided on the sealing cone 69 or else alternatively on the plunger 68, the position of the pointer 75 being able to be seen by the user from the outside through a viewing window 76.

Figure 25:
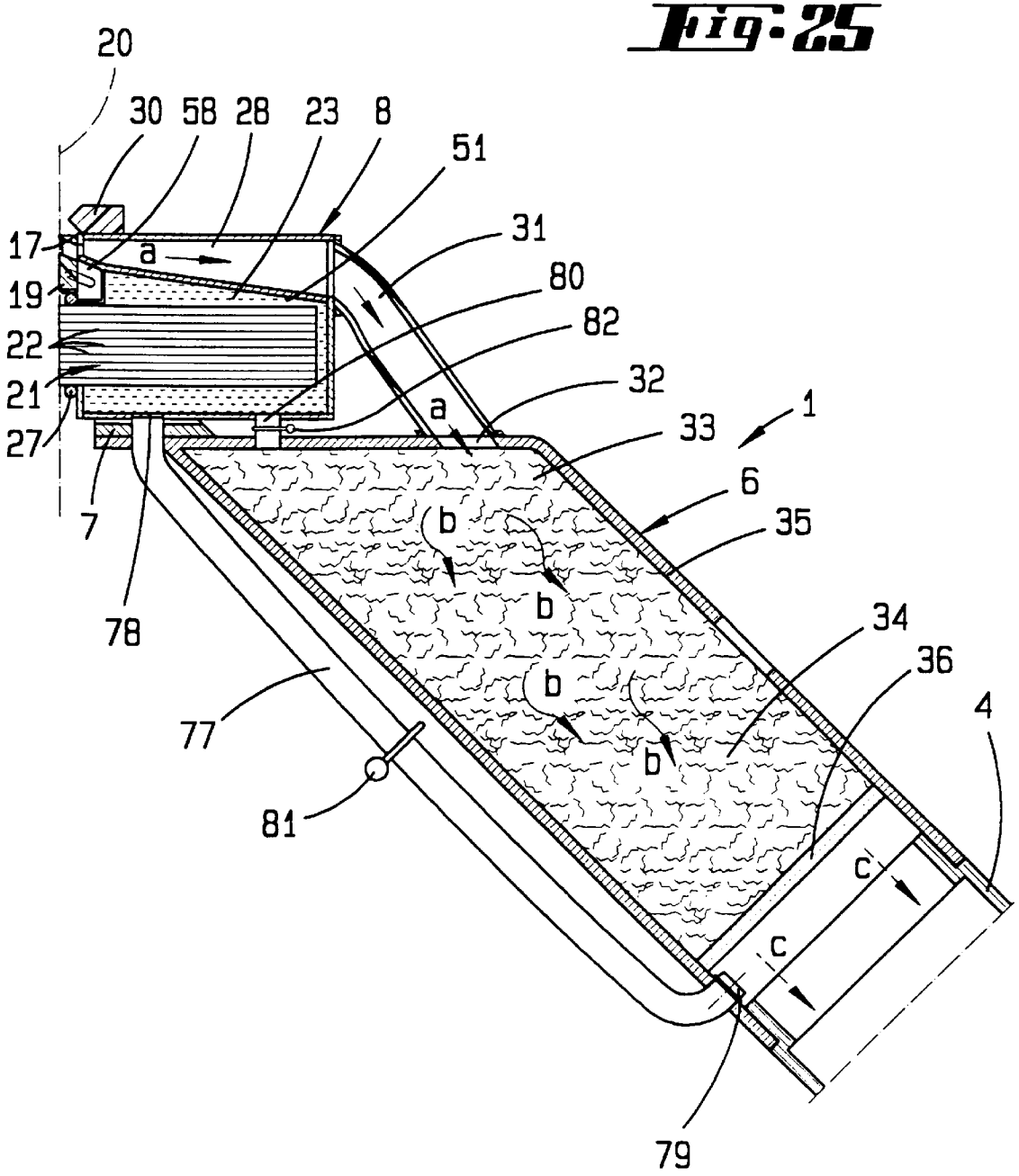
FIG. 25 shows a schematic illustration of a device for feeding back liquid.

As already mentioned, the filtered liquid may be fed back out of the liquid store 35 to the capillary store 26. An exemplary configuration is illustrated in FIG. 25.

To this end, on the exemplary embodiment of the vacuum cleaner attachment 1 already explained in FIG. 20, a switchable flow connection 77 in the form of a flexible hose is provided. This flow connection is connected between the capillary store 26 and that side of the membrane 36 which faces the suction blower or faces away from the liquid store 35. A water-impermeable seal 78, optionally in the form of a membrane, is preferably provided in the region of the entry of the flow 20 connection 77 into the capillary store 26. Furthermore, an air filter 79 may be provided at the point of connection of the flow connection 77 to the suction channel 28.

Furthermore, a liquid return connection 80 is provided between the 25 capillary store 26 and the liquid store 35, which connection may also be a flexible hose.

By means of this configuration, it is made possible for the filtered liquid to be sucked back out of the liquid store 35 into the capillary store 26. No further means are thus necessary for refilling the capillary store 26 with the liquid present in the liquid store 35. In order to feed back in this way, it is only necessary to carry out a switching of the flow connections 77 and 80, for example by the release switches 81 and 82 being actuated by the user. The release switches 81 35 and 82 are shown only schematically in FIG. 25.

After the flow connections 77 and 80 have been released, the capillary store 26 has a greater negative pressure applied to it than prevails in the liquid store 35. The liquid that is held in the liquid store 35 and has been filtered is sucked back into the capillary store 26 via the return connection 80, the air flow path being deflected with respect to a normal working position via the flow connection 77.

As already mentioned, the releasing of the flow connections may be effected by actuating release switches. However, it is also conceivable for a push button switch to be provided in the region of the working holder 8, which switch releases the flow connection 77 and optionally also the return connection 80, on lifting from the surface 20 to be cleaned. Accordingly, when the vacuum cleaner attachment 1 is placed onto a surface to be cleaned, corresponding shut-off elements are brought into a closed position of the flow connection.

Furthermore, the feeding back of liquid from the liquid store 35 into the capillary store 26 may be effected by the liquid store 35 and the capillary store 26 being connected via suitable capillary conveying lines, which implement the pressure difference necessary for the conveying. In this case, preference is given to the conveying being effected only in the periods in which the user has switched off the appliance. In the case of such an arrangement, a non-return valve or the like is advantageously inserted in the region of the capillary conveying lines.

Figure 26:
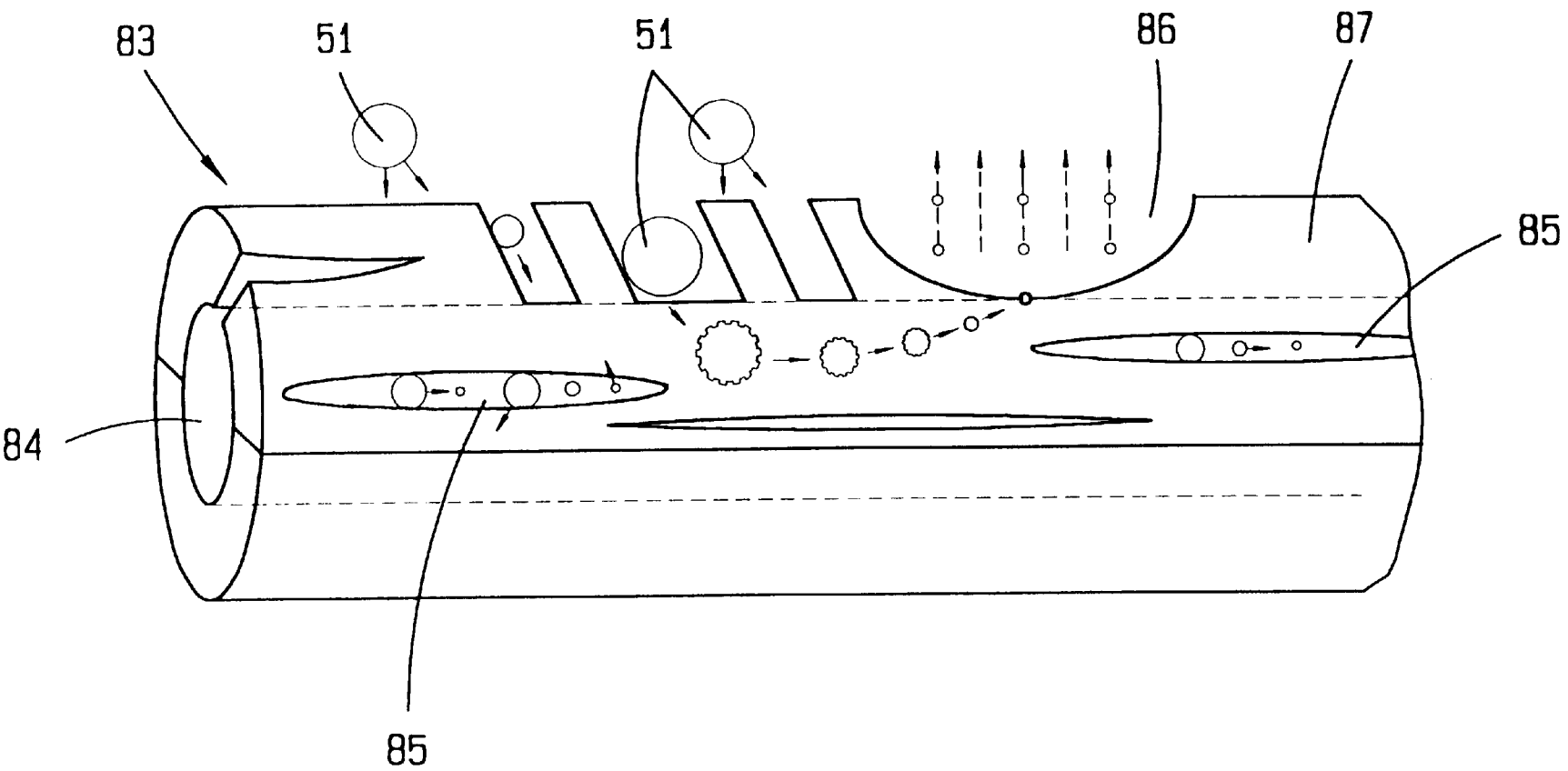
FIG. 26 shows a schematic illustration of a textile fiber in the storage medium.
Figure 27:
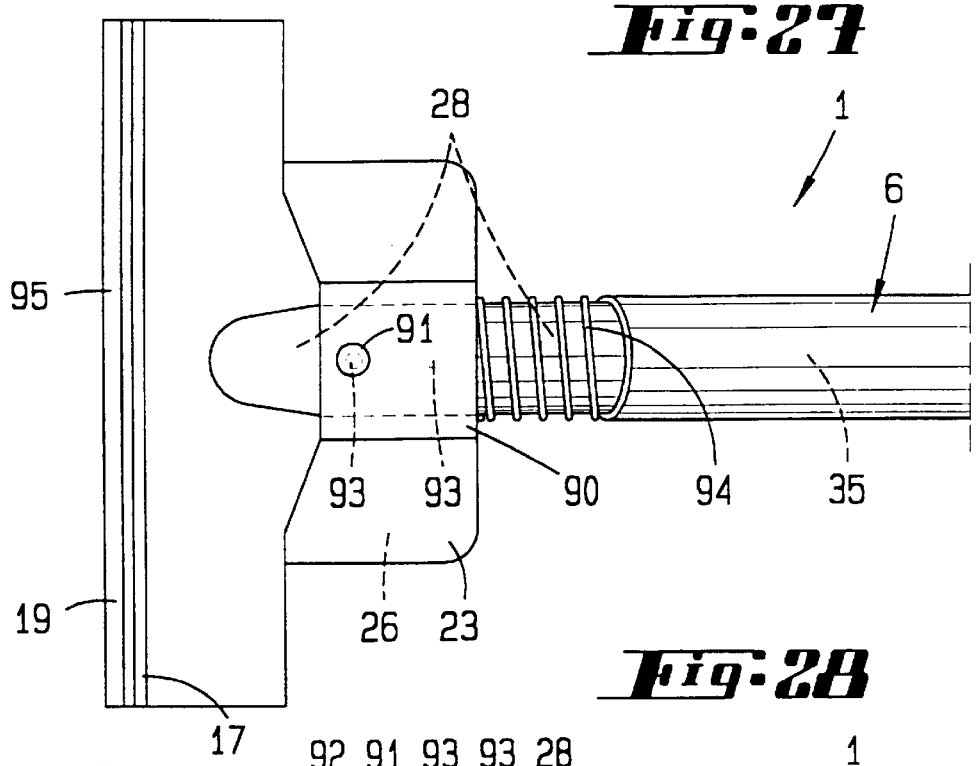
FIG. 27 shows a further embodiment of the vacuum cleaner attachment, in a plan view, a liquid applicator and a capillary store being able to be displaced axially counter to a spring with respect to a suction channel and a lip.

Shown schematically in FIG. 26, in a much enlarged illustration, is the principle of intermediate storing and atomization of the amounts of water sucked up. In one configuration, the storage medium 34 may preferably consist of textile fibers 83 which, on the one hand, store the liquid 51 sucked up in micro-cavities 84, transport it by capillary action and deliver it to the surface 87 through micro-slits 85 or micro-openings 86, from which surface it can atomize rapidly. As a result of this configuration, the relative humidity of the air volume flow delivered remains below the dew point, by which means danger, for example as a result of electric short-circuits, is ruled out.

Illustrated in FIGS. 27 to 31 is a vacuum cleaner attachment 1 in a further alternative configuration. What is significant here is that the liquid applicator 21, together with the liquid supply tank 23 and the capillary store 26, can be displaced axially relative to the lip 17 and the mouth 15 of the suction channel.

Lip 17, suction channel mouth 15 and the suction channel 28 are formed as a connected-together appliance part, the suction channel 28, just as in the other exemplary embodiments, opening into a liquid store 35 provided in the coupling housing 6. In relation to a longitudinal axis of the suction channel 28, the coupling housing 6 is arranged bent at an angle to this channel. The suction channel 28 also forms the constructional connection between coupling housing 6 and the region accommodating the lip 17 and the mouth 15 of the suction channel. In this exposed region, the suction channel 28 and its outer wall are formed to be circular in cross-section.

The liquid supply tank 23 accommodating the capillary store 26 is located on the underside, that is to say arranged in front of the mouth 15 of the suction channel in the working direction R, the liquid applicator 21 being provided on the front side of the said liquid supply tank 23, facing the surface 20 to be cleaned, as also in the previously described exemplary embodiments. In a plan view according to FIG. 27, the liquid supply tank 23 projects on both sides of the suction channel 28 beyond the latter and has a sleeve-like connecting element 90 surrounding the suction channel 28 and its outer wall. Via this sleeve-like connecting element 90, the appliance part, essentially comprising liquid applicator 21 and capillary store 26, is held on the second appliance part essentially having the lip 17 and the suction channel 28. As a result of this configuration, the liquid applicator 21, together with its capillary store 23, can be displaced axially along the suction channel 28.

Figure 28:
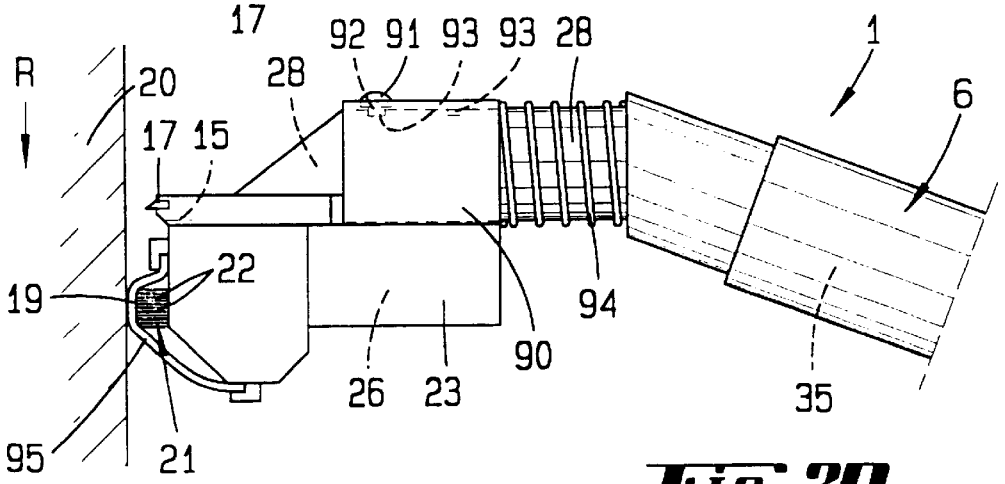
FIG. 28 shows the vacuum cleaner attachment according to FIG. 27 in a side view, relating to a frontmost latching position of the liquid applicator and capillary store.
Figure 29:
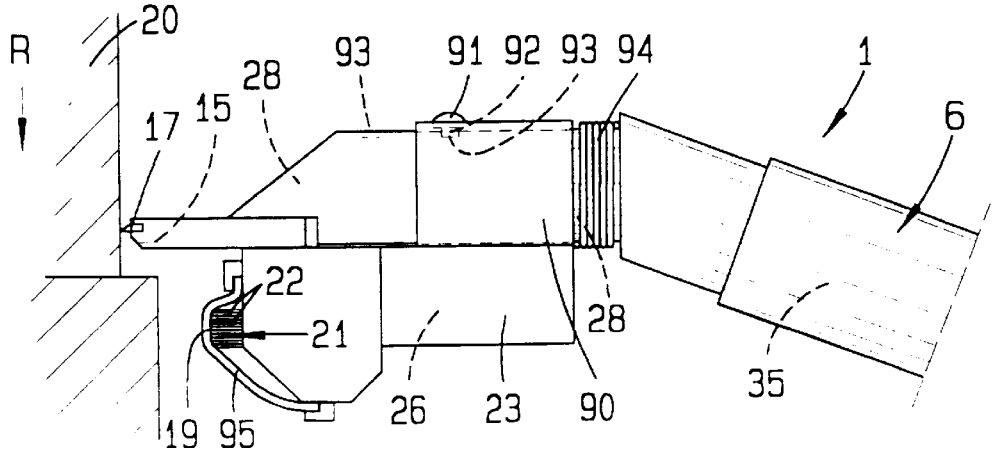
FIG. 29 shows an illustration corresponding to FIG. 28, but relating to a rearmost position.

The connecting element 90 has an actuating knob 91 by means of which it is possible to fix a frontmost position illustrated in FIG. 28 and a rearmost position illustrated in FIG. 29. Via this actuating knob 91, as required, a latching pin 92 or the like can be introduced into correspondingly shaped latching recesses 93 in the connecting element 90. The entire latching device is illustrated only schematically in the drawings.

Provided between the connecting element 90 and a shoulder that is moulded in the transition region from the suction channel 28 to the coupling housing 6 is a spring 94 arranged concentrically with the suction channel 28, which spring has the action of spring-loading the housing part with the liquid applicator 21 and the capillary store 26 in the direction of a frontmost position. Accordingly, displacement in the direction of a rearmost position is performed counter to the spring force.

Furthermore, the cleaning element 19 is formed by a cleaning cloth 95, preferably as a micro-nonwoven cloth, which is tensioned over the liquid applicator 21. This cleaning cloth 95 is secured, for example held by clamping, to the housing, at one end in the region between the liquid applicator 21 and the mouth 15 of the suction channel and at the other end on that side of the liquid applicator 21 facing away from the mouth 15 of the suction channel, this holding being illustrated only schematically. As can be seen, for example, from FIG. 28, a construction is preferred in which the other end is secured to an underside of the housing. Further preferred is a configuration in which the cleaning cloth 95 can be exchanged, for example for cleaning purposes.

In the course of cleaning a surface 20 to be worked on, the cleaning cloth 95 is wetted on the rear side by the liquid applicator 21.

Furthermore, the vacuum cleaner attachment 1 may be provided with a scraper edge, not shown, in order to remove stubborn contaminants.

In order, in a first working step, to begin to dissolve or to begin to soften coarse contaminants, for example, on the surface 20 to be cleaned, the liquid applicator 21, together with the capillary store 26, is displaced into a frontmost position and secured by a latch. This position is illustrated in FIG. 28. It can be seen that the liquid applicator 21 and, respectively, the cleaning element 19 provided in the form of a cleaning cloth 95 is positioned in front in plane terms of the lip 17, so that the surface 20 can be worked on by the cleaning cloth 95, which is wetted on the rear side, without the lip 17 drawing off the liquid applied. This yields the possibility of separate wetting, for example for washing the surface 20 to be cleaned without suction.

In order to achieve a hard-edge function according to FIG. 29, the liquid applicator 21, together with its capillary store 26, is displaced into the rearmost position and secured there by a latch. In this case, the liquid applicator 21 and, respectively, the cleaning cloth 95 are aligned so that they are set back in plane terms in relation to the lip 17, whereby subsequently the hard surface 20 is contacted only by the lip 17, this for example in order to draw off residual moisture in regions which are difficult to access or in order to dry, for example, glass panes following rain.

Figure 30:
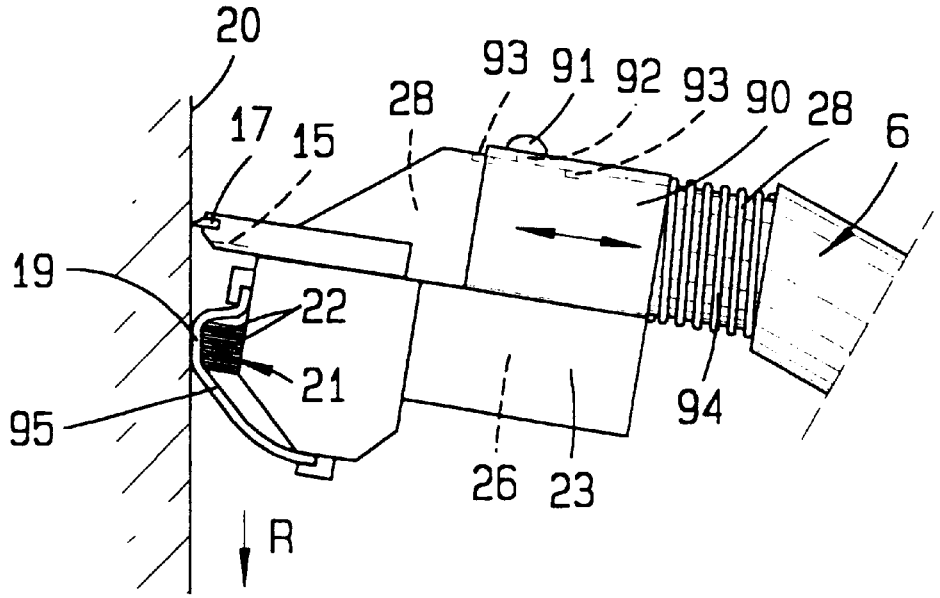
FIG. 30 shows a further illustration, corresponding to FIG. 28, but relating to a non-latched position, in which the liquid applicator and the capillary store are freely axially displaceable with respect to the lip, for an inclination of the vacuum cleaner attachment at an acute angle to the surface to be cleaned.
Figure 31:
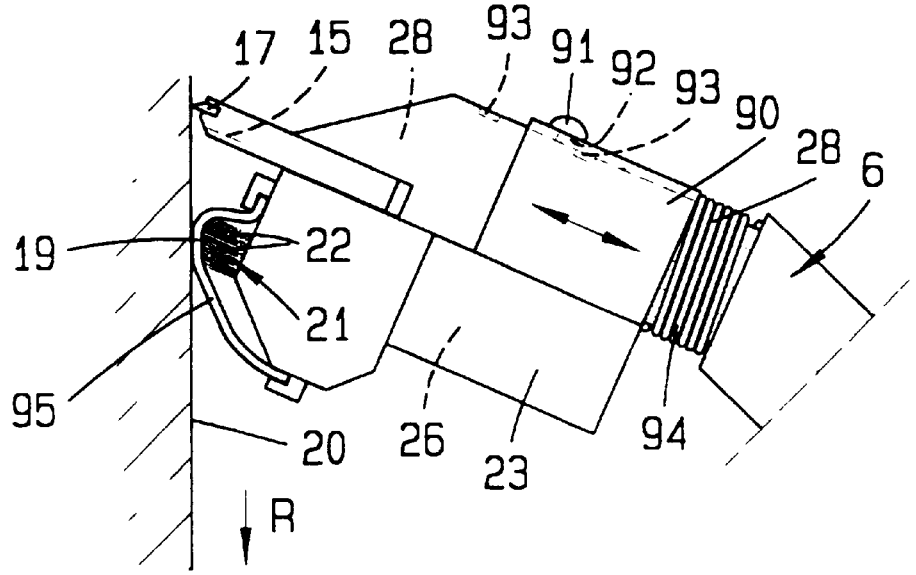
FIG. 31 shows an illustration corresponding to FIG. 30, but relating to a further, angled alignment of the vacuum cleaner attachment in relation to the surface to be cleaned.

The latching means defining the frontmost and the rearmost position may also be dispensed with completely according to the invention, with the result that the appliance part accommodating the liquid applicator 21 and the capillary store 26 is freely displaceable on the suction channel 28 or on its outer wall. This shows itself to be advantageous in the normal use of the vacuum cleaner attachment 1, since as a result of this configuration the liquid applicator 21 and, respectively, the cleaning cloth 95 tensioned over the latter, and the lip 17 always rest on the surface 20 to be cleaned, even when in the course of working in the direction of the arrow R, the vacuum cleaner attachment 1 may sometimes be tilted more and sometimes tilted less. The cleaning cloth 95 and the liquid applicator 21 always automatically assume the position contacting the surface 20, as a result of the spring loading by the spring 94. FIGS. 30 and 31 show two different angular positions of the vacuum cleaner attachment 1 in relation to the surface 20 to be cleaned, in FIG. 30 the attachment 1 including approximately an angle of about 80° and in FIG. 31 including approximately an angle of about 70° in relation to the surface 20. As a result of the configuration according to the invention, an angular range of about 30–50°, preferably 40°, is provided, in which there is always contact between lip 17 and cleaning cloth 95 and the surface 20.

Figure 32:
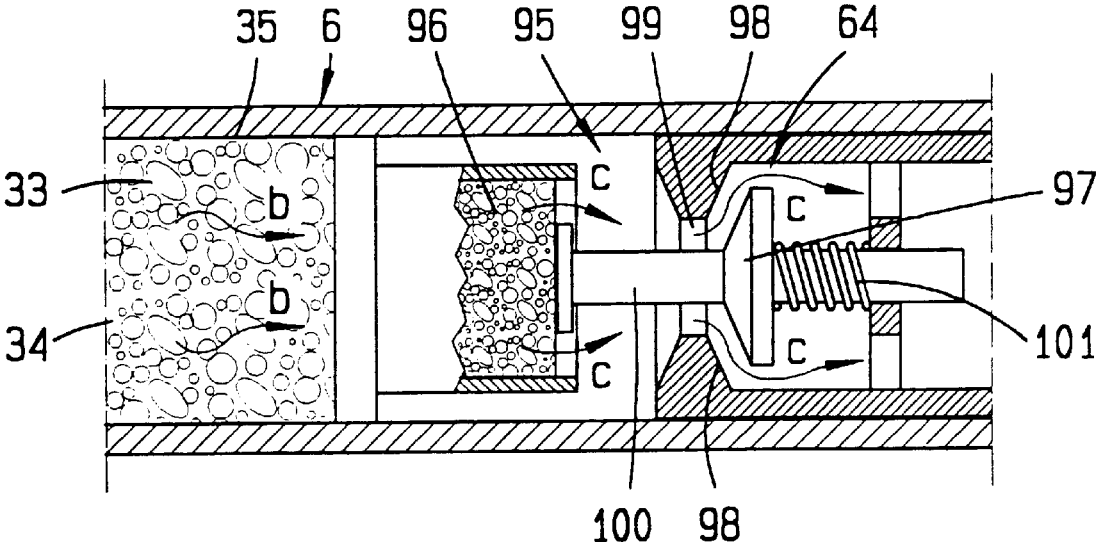
FIG. 32 shows a further schematic illustration of an alternative safety element, in an open position.
Figure 33:
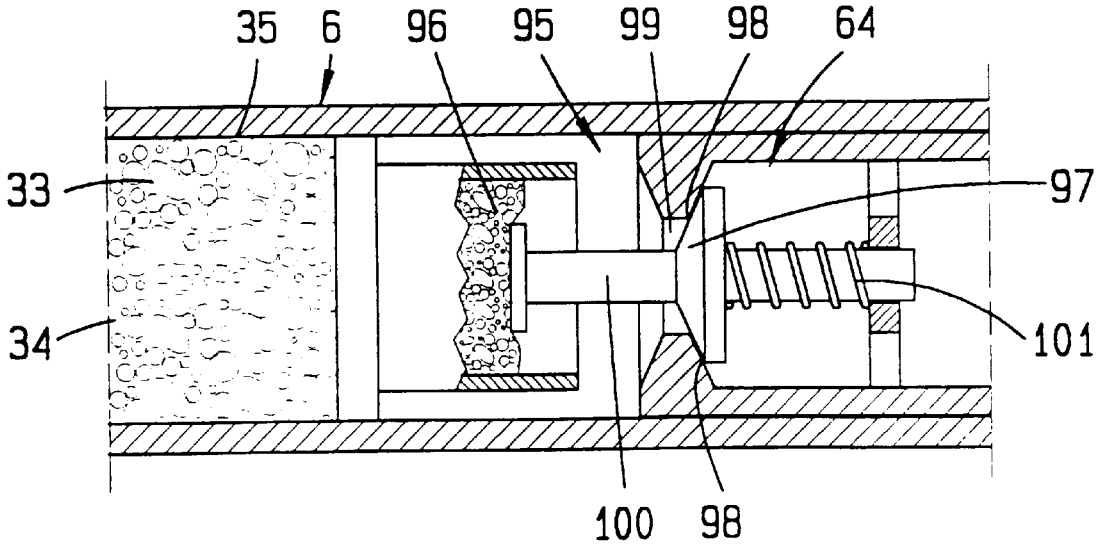
FIG. 33 shows an illustration corresponding to FIG. 32, but relating to the closed position.

Depicted in FIGS. 32 and 33, in a further embodiment, is a safety element 95 for the controllable triggering of the suction in dependence on a specific filling level of the liquid store 35. It can be seen that a blocking element 96 in the form of a sponge-like material, such as a natural sponge, is located downstream of the liquid store 35, which is an open pore foam or the like in the exemplary embodiment shown. This sponge-like blocking element 96 is in direct contact with the rear end, viewed in the suction direction, of the liquid store 35.

The blocking element 96 is acted on by a valve 64 on that side facing away from the liquid store 35. The said valve has a sealing cone 97 in order to interact with a sealing wall 98 on the side of the coupling housing. Provided in the region of the sealing wall 98 is an axial bore 99 for the passage of a control element 100, via which control element 100 the sealing cone 97 is supported on the blocking element 96. In addition, the sealing cone 97 is acted on in the direction of the blocking element 96 by a compression spring 101.

FIG. 32 shows a position in which the valve 64 is held in an open position. The valve 64 is supported in this case via the control element 100 on the blocking element 96, a passage region for the suction being formed between the sealing wall 98 and the sealing cone 97. If the liquid store 35 reaches its maximum filling level, then the sponge-like blocking element is acted on by moisture, which leads to a softening of the material and results in compressibility of the blocking element 96. As a result of this moisture-dependent compressibility, it is made possible for the valve 64 to pass into the closed position, on account of the spring bias. This position is illustrated in FIG. 33. The control element 100 compresses the blocking element 96 in such a way that the sealing cone 97 provided on the control element 100 is engaged against the sealing wall 98 in a sealing manner in order to interrupt the suction.

After the liquid store 35 has been emptied, the blocking element 96 decompresses automatically because of the gradual drying out, in so doing hardens once more and displaces the valve 64 back into the initial position according to FIG. 32.

The above described configuration of the safety element 95 is also conceivable for other containers that take up liquid, which are intended to be closable automatically when a predetermined filling level is reached.

We claim:

1. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and wherein the liquid applicator (21) comprises a plurality of tufts of bristles for dispensing liquid from the liquid applicator said tufts having free ends lying within said supply tank.

2. Vacuum cleaner attachment according to claim 1, wherein with respect to application area, the liquid application (21) is subdivided into substructures.

3. Vacuum cleaner attachment according to claim 1, wherein the tuft of bristles comprises bristles (22) which include an angle (alpha) of about 30–60° with a front face of the attachment.

4. Vacuum cleaner attachment according to claim 1, wherein the liquid applicator (21) is disposed in a capillary store (26), conveying of liquid of the applicator being effected from the capillary store (26) by capillary action.

5. Vacuum cleaner attachment according to claim 1, wherein the mouth (15) of the suction channel has an elongated form.

6. Vacuum cleaner attachment according to claim 1, wherein the cleaning element (19) defines an edge of the mouth (15) of the suction channel.

7. Vacuum cleaner attachment according to claim 1, wherein the cleaning element (19) comprises a sealing element, and a cleaning nonwoven fabric fitted thereto, the sealing element serving to seal off the mouth of the suction channel from the liquid applicator.

8. Vacuum cleaner attachment according to claim 1, wherein an edge region of the mouth (15) of the suction channel, located downstream in a direction of application (R), comprises a lip (17) which is impermeable to air.

9. Vacuum cleaner attachment according to claim 8, wherein a suction channel section (52) is partially bounded by the lip (17).

10. Vacuum cleaner attachment according to claim 1, wherein the mouth (15) of the suction channel comprises a multiplicity of individual suction channel sections (52).

11. Vacuum cleaner attachment according to claim 10, wherein the suction channel sections (52) are arranged at an oblique angle relative to a front face of the attachment, and are directed towards the suction channel (28).

12. Vacuum cleaner attachment according to claim 1, further comprising a lip (17) formed as a double lip.

13. Vacuum cleaner attachment according to claim 1, further comprising a residual water wiper (30) further downstream of a lip (17).

14. Vacuum cleaner attachment according to claim 1, wherein the cleaning element (19) is removably secured between the mouth (15) of the suction channel and the liquid applicator (21).

15. Vacuum cleaner attachment according to claim 1, further comprising a pivotable working holder (8), and wherein the liquid applicator (21), the cleaning element (19) and the mouth (15) of the suction channel are disposed in said pivotable working holder (8).

16. Vacuum cleaner attachment according to claim 1, further comprising a filter (33) connecting with the suction line for storing material sucked in by the suction line, a fluid conduction line connecting between the liquid applicator and the filter, a bypass fluid conduction line connecting with the liquid applicator and bypassing the filter to connect an air outlet of the filter, and a release switch (81), and wherein releasing of the bypass line is effected by actuating said release switch (81).

17. Vacuum cleaner attachment according to claim 1, wherein feeding of liquid by the applicator is effected via capillary transport.

18. Vacuum cleaner attachment according to claim 1, wherein the liquid applicator (21) is displaceable together with a capillary store (26).

19. Vacuum cleaner attachment according to claim 1, wherein the liquid applicator is displaceable relative to a housing of the attachment between a frontmost position and rearmost position, the attachment including means for latching the liquid applicator into at least one of said frontmost and said rearmost position of the liquid applicator (21).

20. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and wherein the attachment further comprises an inner lip, and an outer lip (54) made of a material which is softer than the inner lip (17), the outer lip being located outside the mouth, and the inner lip being located between the outer lip and the mouth.

21. Vacuum cleaner attachment according to claim 20, wherein the outer lip (54) is formed with a greater spacing than the inner lip from the surface (20) to be cleaned such that, during a normal cleaning operation said outer lip does not come into contact with the surface (20) to be cleaned.

22. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and wherein the attachment further comprises a lip (17) located adjacent the mouth and having, on a side thereof facing the liquid applicator (21), channels (55) running in a width direction of the lip (17), said channels widening in their cross-section towards the suction channel (28).

23. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and wherein an appliance part is located between the mouth (15) of the suction channel and the liquid applicator (21), and is displaceable relative to the suction channel for establishing a cross-sectional dimensional of the suction channel.

24. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and wherein the attachment further comprises a filter (33), and wherein the suction channel (28) extends through said filter (33), the filter (33) filtering sucked-up liquid out of sucked-up air.

25. Vacuum cleaner attachment according to claim 24, wherein the filter (33) cooperates with a storage medium (34) for filtering out, to form a liquid store (35).

26. Vacuum cleaner attachment according to claim 25, wherein the storage medium (34) has a fibrous material which sucks up moisture by capillary action, optionally by means of a tubular configuration of fibers (83), and releases it through micro-slits (85) only by evaporation.

27. Vacuum cleaner attachment according to claim 25, wherein the sucked-up air passes through the storage medium (34) on labyrinth paths such that, optionally by means of filtering out, liquid separation is effected by deflecting the flow.

28. Vacuum cleaner attachment according to claim 25, wherein the storage medium (34) is open-pore foam and/or active carbon.

29. Vacuum cleaner attachment according to claim 25, wherein the suction is controllable, actuatable by a specific degree of filling of the liquid store (35).

30. Vacuum cleaner attachment according to claim 25, further comprising a valve (64), and wherein a pressure drop which is established by degree of filling of the liquid store (35) is used for closing movement of the valve (64) closing the suction channel (28).

31. Vacuum cleaner attachment according to claim 30, wherein a front side of the valve supports a membrane (36) at a high degree of filling of the liquid store (35).

32. Vacuum cleaner attachment according to claim 30, wherein the closing valve (64) has a diaphragm base which is loaded on one side by pressure prevailing upstream of a liquid-impermeable membrane (36) and on the other side by the pressure of the suction channel (28).

33. Vacuum cleaner attachment according to claim 30, wherein an adjusting movement of the valve (64) is transferred to an indicator in order to display the degree of filling of the liquid store (35).

34. Vacuum cleaner attachment according to claim 25, wherein the liquid store (35) is made at least partially of a swelling material (61) which changes in a sense of an increase in volume on taking up liquid.

35. Vacuum cleaner attachment according to claim 34, wherein a separate flow path (63) is provided in the swelling material (61).

36. Vacuum cleaner attachment according to claim 35, wherein the separate flow path (63) is formed such that it changes direction with a view to enlarging surface.

37. Vacuum cleaner attachment according to claim 35, wherein a wall of the separate flow path (63) is made partially or completely of the swelling material (61).

38. Vacuum cleaner attachment according to claim 34, wherein a liquid-impermeable membrane (36) is located upstream of the swelling material (61).

39. Vacuum cleaner attachment according to claim 34, wherein the swelling material (61) is polyacrylate.

40. Vacuum cleaner attachment according to claim 25, wherein the liquid stored in the storage medium (34) can be fed back to the liquid applicator (21).

41. Vacuum cleaner attachment according to claim 25, wherein the liquid (51) can be sucked back out of the liquid store (35) into a capillary store (26).

42. Vacuum cleaner attachment according to claim 41, wherein a switchable flow connection (77) is provided between a side of membrane (36) on a blower side and the capillary store (26).

43. Vacuum cleaner attachment according to claim 42, wherein the flow connection (77) is opened in a state of the vacuum cleaner attachment (1) not resting on the surface (20) to be cleaned.

44. Vacuum cleaner attachment according to claim 42, further comprising a push-button switch provided on the vacuum cleaner attachment (1), said push-button switch releases the flow connection (77) when lifted off from the surface (20) to be cleaned.

45. Vacuum cleaner attachment according to claim 41, wherein the capillary store (26) is connected to the liquid store (35) via capillary conveying lines.

46. Vacuum cleaner attachment according to claim 25, wherein introduction of suction air and feeding back of liquid in the liquid store (35) are physically removed from each other so far that the liquid fed back is at least adequately cleaned of dirt particles carried in the suction air.

47. Vacuum cleaner attachment according to claim 25, wherein the liquid store (35) is equipped with a filling level indicator (37).

48. Vacuum cleaner attachment according to claim 47, wherein the filling level indicator (37) is a capillary sensor (39).

49. Vacuum cleaner attachment according to claim 25, wherein the liquid store (35) is equipped with a negative pressure sensor to register state of loading.

50. Vacuum cleaner attachment according to claim 24, wherein the filter (33) is bounded in suction direction by a liquid-impermeable membrane (36).

51. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and wherein an edge (42) of the mouth (15) of the suction channel is moveable out on one side, specifically on a side facing the liquid applicator (21) such that, optionally during a tilting of a working holder (8) of the attachment, in event of the mouth (15) of the suction channel resting further on the surface (20) to be cleaned, a lifting off of the liquid applicator (21) and, optionally, of the cleaning element (19), is effected.

52. Vacuum cleaner attachment according to claim 51, wherein the movable edge (42) of the mouth of the suction channel is moveable substantially in suction direction.

53. Vacuum cleaner attachment according to claim 51, wherein when the edge (42) of the mouth of the suction channel is moved out, a front edge (47) is displaced such that a comb construction comes into effect to form closely bounded suction channels (49).

54. Vacuum cleaner attachment according to claim 53, wherein the front edge (47) is pivotably mounted in the working holder (8).

55. Vacuum cleaner attachment according to claim 51, wherein the movable edge (42) of the mouth of the suction channel, forming a rear edge (48), is formed like a comb.

56. Vacuum cleaner attachment according to claim 55, wherein the rear edge (48) is formed like a plough to provide closely bounded suction channels (50).

57. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and wherein the liquid applicator (21) is displacable with respect to a lip (17) of the mouth such that the liquid applicator (21) can be moved towards or away from the surface (20) to be cleaned.

58. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and wherein the suction channel (28) is formed to be static, and the liquid applicator (21), together with capillary store (26) of the tank, is displaceably disposed on the suction channel (28).

59. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and wherein the attachment further comprises a spring (94), and wherein the liquid applicator (21) is displacable back counter to said spring (94).

60. Vacuum cleaner attachment according to claim 59, wherein the spring (94) is arranged concentrically with the suction channel (28).

61. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and further comprising a sleeve-like connecting element, and wherein the liquid applicator (21), includes a capillary store (26) located in the tank, and is held on the suction channel (28) by the sleeve-like connecting element (90).

62. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and wherein the cleaning element (19) comprises a cleaning cloth (95) which is wetted on a rear side facing away from the surface to be cleaned.

63. Vacuum cleaner attachment according to claim 62, wherein the cleaning element further comprises a capillary device, and the cleaning cloth (95) is tensioned over the capillary device and is wetted via the latter.

64. Vacuum cleaner attachment (1) for wet cleaning of a surface (20), particularly a vertical surface, comprising:

a liquid applicator (21), a suction channel (28) having a mouth (15) spaced apart from the liquid applicator, and a cleaning element (19) adjacent the liquid applicator, wherein the liquid applicator (21) is operative for continuous supply of liquid to enable continuous working, wherein a liquid supply tank (23) for supplying the liquid applicator (21) is disposed in the vacuum cleaner attachment (1), the liquid applicator (21) being supplied with liquid from the tank by means of capillary action; and wherein the attachment further comprises a blocking element, and a valve (64) which is held in an open position by the blocking element (96), said blocking element (96) being actuatable by application of moisture.

65. Vacuum cleaner attachment according to claim 64, wherein the blocking element (96) comprises a material which takes up moisture, and which can be compressed in dependence on a specific amount of liquid taken up.

66. Vacuum cleaner attachment according to claim 64, wherein the blocking element (96) is made of a sponge-like material.

* * * * *